US012557911B2

(12) United States Patent
Sullivan et al.

(10) Patent No.: US 12,557,911 B2
(45) Date of Patent: Feb. 24, 2026

(54) CHAISE LOUNGE

(71) Applicant: Outer, Inc., Santa Monica, CA (US)

(72) Inventors: Scott Sullivan, San Francisco, CA (US); Terry Kang Lin, San Francisco, CA (US)

(73) Assignee: OUTER, INC., Santa Monica, CA (US)

( * ) Notice: Subject to any disclaimer, the term of this patent is extended or adjusted under 35 U.S.C. 154(b) by 194 days.

(21) Appl. No.: 18/220,354

(22) Filed: Jul. 11, 2023

(65) Prior Publication Data

US 2024/0008648 A1 Jan. 11, 2024

Related U.S. Application Data

(63) Continuation of application No. PCT/US2023/026974, filed on Jul. 6, 2023.
(Continued)

(51) Int. Cl.
*A47C 1/14* (2006.01)
*A47C 1/026* (2006.01)
*A47C 7/28* (2006.01)

(52) U.S. Cl.
CPC ..... *A47C 1/143* (2013.01); *A47C 1/026* (2013.01); *A47C 7/282* (2013.01)

(58) Field of Classification Search
CPC ..... A47C 7/282; A47C 1/143
See application file for complete search history.

(56) References Cited

U.S. PATENT DOCUMENTS 3,844,612 A * 10/1974 Borggren ..... A47C 31/04 297/451.3
5,338,091 A * 8/1994 Miller ..... A47C 5/06 297/226
(Continued)

FOREIGN PATENT DOCUMENTS

CA 3012345 A1 * 9/2019 ..... A47C 31/023
CN 110973877 A * 4/2020 ..... A47C 1/024
(Continued)

OTHER PUBLICATIONS

International Search Report for PCT/US23/26974, Dated Nov. 17, 2023, 6 pages.

*Primary Examiner* — Timothy J Brindley
(74) *Attorney, Agent, or Firm* — RANKIN, HILL & CLARK LLP

(57) ABSTRACT

A chaise lounge includes a frame, a first sling anchor, a second sling anchor, a sling and a threaded fastener. The frame includes at least two side members. The first sling anchor connects with a first side member and is movable with respect to the frame. The second sling anchor connects with a second side member. The second side member is disposed on an opposite side of the frame from the first side member. The sling is secured to the first sling anchor and the second sling anchor and spans between the first side member and the second side member. The sling defines a support surface on which an associated occupant may selectively reside. The threaded fastener engages the first sling anchor and the first side member. Rotation of the threaded fastener with respect to at least one of the first sling anchor and the first side member results in movement of the first sling anchor with respect to the first side member, which results in movement of the sling with respect to the first side member.

20 Claims, 11 Drawing Sheets

Related U.S. Application Data

(60) Provisional application No. 63/359,532, filed on Jul. 8, 2022.

(56) References Cited

U.S. PATENT DOCUMENTS

| | | | | | |
|---|---|---|---|---|---|
| 5,762,403 | A * | 6/1998 | Robinson | A47C 31/023 | 297/440.11 |
| 6,030,040 | A * | 2/2000 | Schmid | A47C 5/06 | 297/226 |
| 6,293,624 | B1 * | 9/2001 | Gaylord | A47C 31/023 | 297/440.1 |
| 6,779,849 | B1 | 8/2004 | Harper et al. | | |
| 2016/0206098 | A1 * | 7/2016 | Rivera | A47C 1/03294 | |
| 2020/0297114 | A1 * | 9/2020 | Holbrook | A47C 31/023 | |

FOREIGN PATENT DOCUMENTS

| | | | | | |
|---|---|---|---|---|---|
| CN | 213216177 | U * | 5/2021 | | |
| EP | 1346665 | A1 * | 9/2003 | A47C 31/02 | |
| JP | 2005034290 | A * | 2/2005 | A47C 31/023 | |
| WO | WO-2013062036 | A1 * | 5/2013 | A47C 31/02 | |
| WO | WO-2017213229 | A1 * | 12/2017 | A47C 31/02 | |
| WO | WO-2022269055 | A1 * | 12/2022 | A47C 31/02 | |

* cited by examiner

CHAISE LOUNGE

BACKGROUND

A conventional chaise lounge includes a rectangular frame with a leg at each corner. A main seat is attached to the frame and is used to support the occupant's lower body. A backrest structure is pivotally attached to the frame and is used to support the occupant's upper body at an inclined position. The backrest is typically held at one of several predetermined angles with a brace assembly which connects between the backrest and the frame.

Slings used for supporting occupants of a conventional outdoor chaise lounge are typically rectangular and include an elongated hemmed pocket along two opposing edges, running the length of the sling. This hemmed pocket is generally used to secure each edge of the sling to each respective side frame member of a conventional chaise lounge. After the hemmed pocket at each edge is positioned within a respective side frame member, an anchor rod is then inserted into the hemmed pocket from one end. The anchor rod is usually circular in cross-section, sized to snuggly fit within the hemmed pocket, and is larger than the width of a slot through which the sling is passed on each side frame member. When the anchor rod is appropriately positioned within the hemmed pocket, and within the side frame member, the hemmed pocket will be unable to pass through slot and sling will therefore remain secured to the side frame member.

One problem with this prior art method for securing a sling to a side frame member is that there is no way to tighten or easily replace the sling, should the sling begin to sag over time, or become damaged. In such instance, an owner's options would include trying to replace the sling, using a relatively complicated process and uncommon tools, and consider replacing the entire chaise lounge.

Although a conventional chaise lounge usually includes a solidly built frame, one problem with conventional chaise lounge construction is that it relies on the quality of several different weld-points and bores. For example, with a typical conventional chaise lounge, the backrest support brace is pivotally attached at a hinge point located on the back of the backrest. This hinge point is typically welded to the backrest assembly and must endure continuous strain and stress as the chaise lounge is used. Should this weld-point fail on a particular chaise lounge at a hotel resort, for example, the hotel would likely just discard the entire chaise lounge. Too much effort and expense would be required to disassemble the chaise lounge, repair the broken weld, by re-welding, repaint the parts, and then reassemble the chaise lounge. The cost to fix the broken chaise lounge may likely exceed the cost of a new replacement. However, a new chaise lounge is expensive and its durability and useful life will again be defined by the weakest weld or part. Conventional chaise lounges are not designed to be easily repaired and generally last between two and three years in a hotel or resort environment. It would be desirable for a chaise lounge to be quickly, easily and cost-effectively repaired, on site, so that the useful life of the original chaise lounges can be extended. Extending the life of a product is an effective and compelling sustainability strategy.

SUMMARY

In view of the foregoing, a chaise lounge includes a frame, a first sling anchor, a second sling anchor, a sling and a threaded fastener. The frame includes at least two side members, at least one cross member connecting the at least two side members and a plurality of legs. The first sling anchor connects with a first side member of the at least two side members and is movable with respect to the frame. The second sling anchor connects with a second side member of the at least two side members. The second side member is disposed on an opposite side of the frame from the first side member. The sling is secured to the first sling anchor and the second sling anchor and spans between the first side member and the second side member. The sling defines a support surface on which an associated occupant may selectively reside. The threaded fastener engages the first sling anchor and the first side member. Rotation of the threaded fastener with respect to at least one of the first sling anchor and the first side member results in movement of the first sling anchor with respect to the first side member, which results in movement of the sling with respect to the first side member.

According to another aspect, a chaise lounge includes a primary frame, a secondary frame, an occupant support and at least one mechanical fastener. The primary frame includes at least two primary side members connected by at least one primary cross member and a ledge projecting inwardly from at least one primary side member of the at least two primary side members toward another primary side member of the at least two primary side members. The ledge includes at least one mounting slot extending therethrough. The secondary frame includes at least two secondary side members connected by at least one secondary cross member. The secondary frame is sized and shaped so that at least one secondary side member of the at least two secondary side members aligns with and is supported by the ledge. The occupant support is secured to each of and spans between the at least two secondary side members. The occupant support defines a support surface on which an associated occupant may selectively reside. The at least one mechanical fastener secures the secondary frame to the ledge, and includes a portion extending through the at least one mounting slot in a direction parallel with a gravitational force being applied on the ledge by the at least one secondary side member when the at least one secondary side member is supported by the ledge.

DETAILED DESCRIPTION

Figure 1:
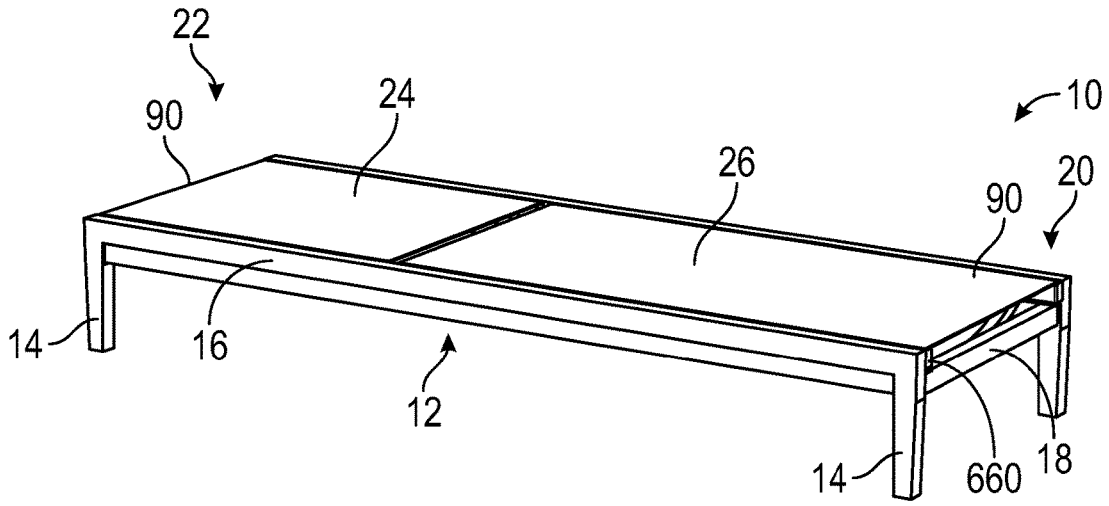
FIG. 1 is a front perspective view of the chaise lounge showing a backrest in a lowered position.
Figure 2:
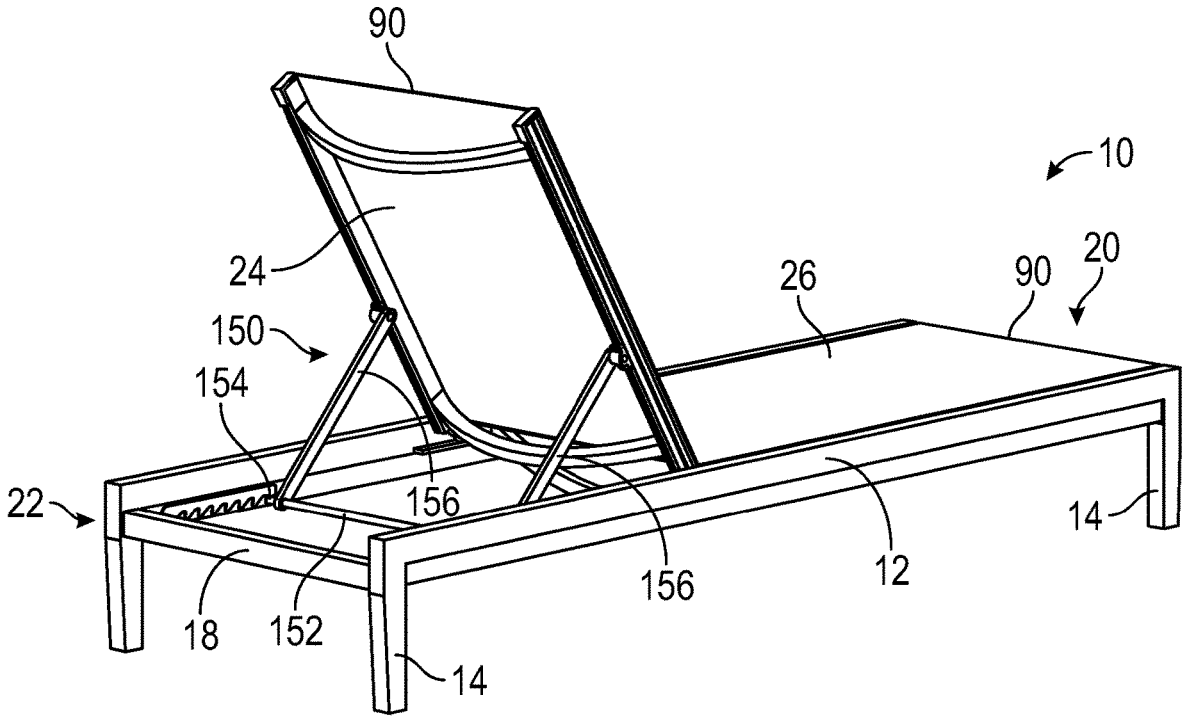
FIG. 2 is a rear perspective view of the chaise lounge of FIG. 1 showing the backrest in a raised position.
Figure 3:
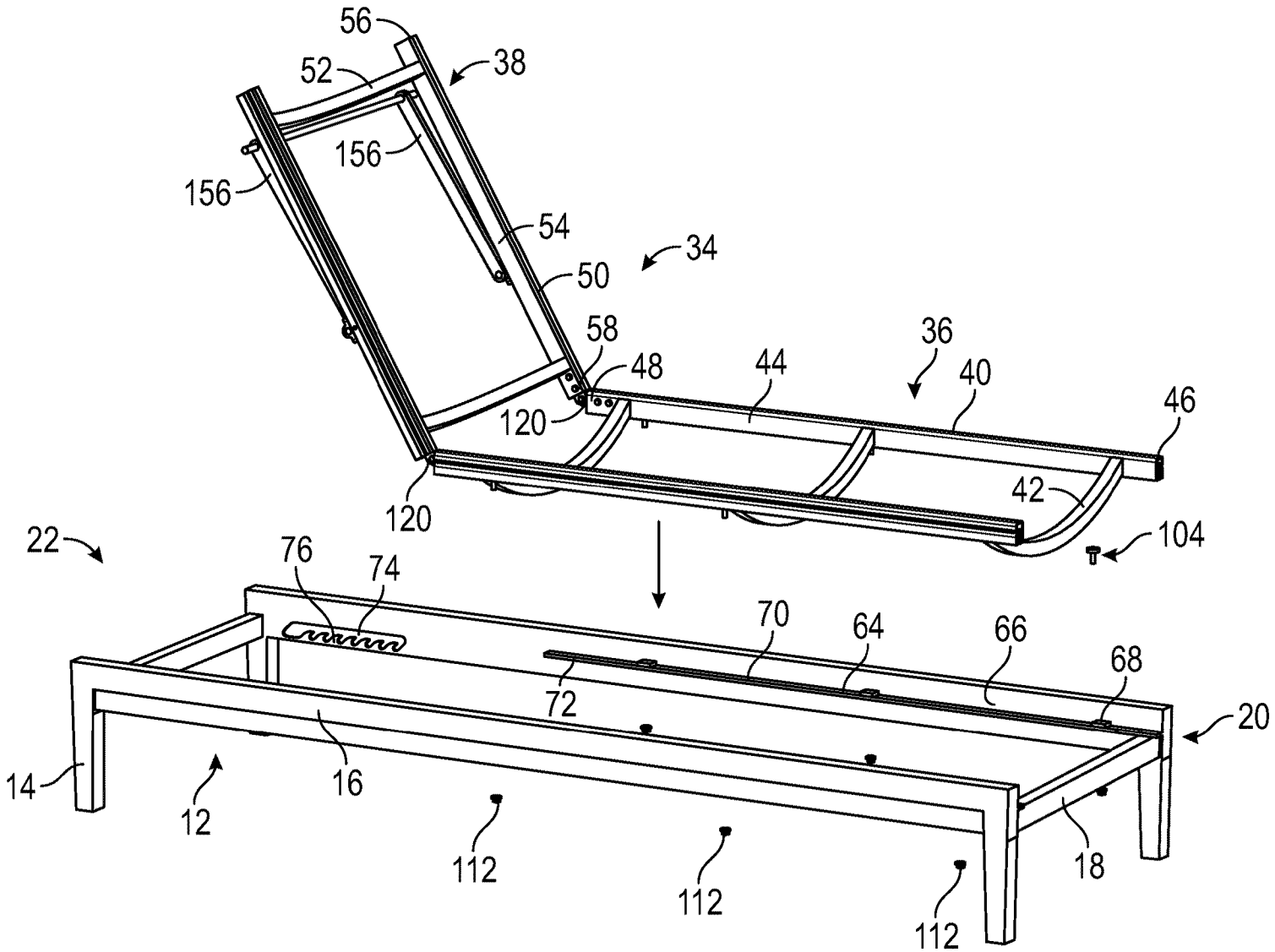
FIG. 3 is a perspective assembly view of the chaise lounge of FIG. 1 showing details of a primary frame and a secondary frame.

Referring to FIGS. 1 and 2, an example of a chaise lounge 10 is shown, according to one embodiment, including a primary frame 12 having four legs 14, two primary side members 16 and two primary cross members 18. The chaise lounge 10 defines a front end 20, where an occupant's feet would reside, when properly using the chaise lounge 10 in a prone position, and a rear end 22, where the occupant's head would rest. The chaise lounge 10 includes a backrest 24 that pivots with respect to a seat 26. As shown in FIG. 3, attached to the primary frame 12 is a secondary frame 34 that includes a seat portion 36, which coincides with the seat 26 shown in FIGS. 1 and 2, and a pivotally attached backrest portion 38, which coincides with the backrest 24 shown in FIGS. 1 and 2.

The seat portion 36 and the backrest portion 38 can be made using similar components, which can facilitate manufacturing and assembly so as to increase efficiency and decrease costs. The secondary frame 34 includes at least two secondary side members connected by at least one secondary cross member. With reference to the embodiment illustrated in FIG. 3, the secondary frame 34 includes two seat portion secondary side members 40 connected by at least one seat portion secondary cross member 42 within the seat portion 36. Each seat portion secondary side member 40 defines an inside surface 44, an open end 46 and a hinge end 48. Each seat portion secondary cross member 42 is secured to the inside surfaces 44 of each seat portion secondary side member 40, preferably welded thereto, so that each seat portion secondary cross member 42 resides perpendicularly to each parallel seat portion secondary side member 40. When connected, the seat portion secondary cross members 42 and the seat portion secondary side member 40 become an assembled rigid structure.

The backrest portion 38 may be assembled similarly to the seat portion 36; however, the backrest portion 38 is made shorter in length than seat portion 36. The secondary frame 34 includes two spaced backrest portion secondary side members 50 connected by at least one backrest portion secondary cross member 52 in the backrest portion 38. Each backrest portion secondary side member 50 defines an inside surface 54, an open end 56 and a hinge end 58. Each backrest portion secondary cross member 52 is secured to the inside surfaces 54 of each backrest portion secondary side member 50, preferably welded thereto so that each backrest portion secondary cross member 52 resides perpendicularly to each parallel backrest portion secondary side member 50. When assembled, the backrest portion secondary cross members 52 and the backrest portion secondary side members 50 become an assembled rigid structure.

Both the seat portion secondary side members 40 and the backrest portion secondary side members 50 can have the same cross section and can be formed via the same extrusion process. This would allow a factory to weld up long assemblies (e.g., 8 to 10 meters long, or even longer) of secondary side members 40, 50 with appropriate secondary cross members 42, 52 (welded at predetermined locations) using appropriate jigs, and thereafter, cut the long assembly to length to quickly and more efficiently create individual seat portions 36 and backrest portions 38. The welding process may be automated to ensure speed and accuracy.

With reference to FIG. 3, the primary frame 12 further includes a ledge 64 projecting inwardly from each primary side member 16. Although only one ledge 64 projecting inwardly from one primary side member 16 is visible in FIG. 3, the other ledge 64 projects inwardly from the opposite primary side member 16 and is aligned longitudinally with the visible ledge in FIG. 3. Each ledge 64 projects perpendicularly from each respective inside surface 66 a prescribed distance (e.g., about 2.5 cm) and further extends from the front end 20 towards the rear end 22. Each ledge 64 includes at least one mounting slot 68 extending therethrough from an upper surface 70 to a lower surface 72. Also formed within each inside surface 66 of each primary side member 16 is a ratchet cutout 74, as shown in FIG. 3, defining engagement teeth 76, located near the rear end 22.

Figure 4:
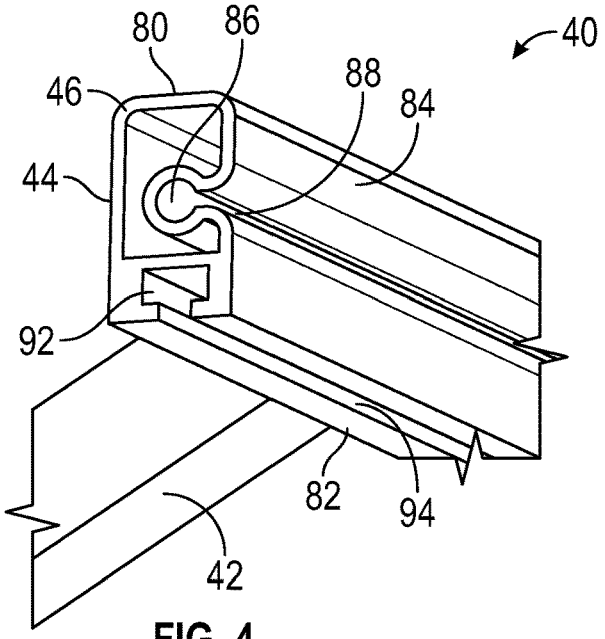
FIG. 4 is a perspective partial view a seat portion secondary side member and a seat portion secondary cross member of the secondary frame shown in FIG. 3.
Figure 5:
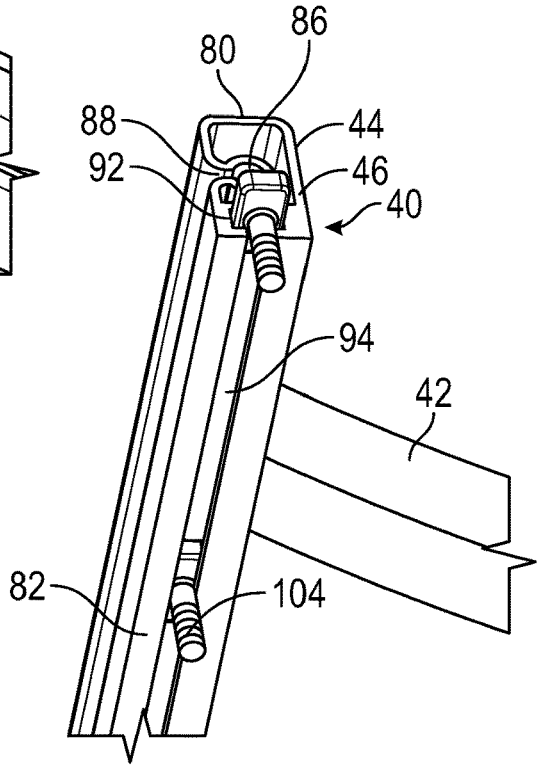
FIG. 5 is a perspective partial view of the seat portion secondary side member and the seat portion secondary cross member of the secondary frame shown in FIG. 3, showing mechanical fasteners being inserted into a lower channel.
Figure 6:
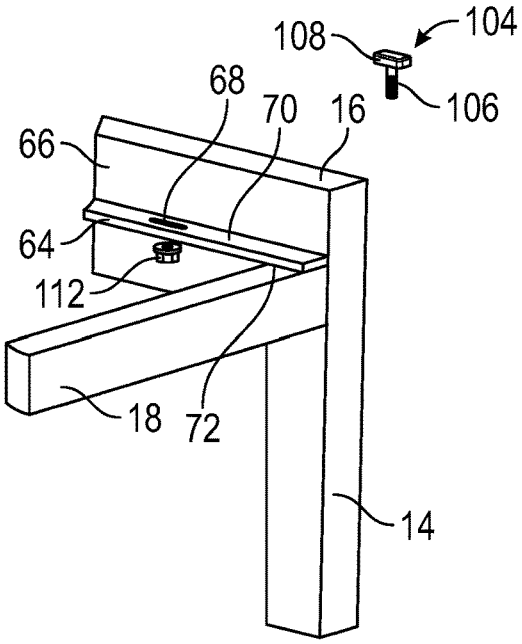
FIG. 6 is a perspective assembly view of the primary frame shown in FIG. 3.

In the illustrated embodiment, both the seat portion secondary side members 40 and the backrest portion secondary side members 50 are an extrusion, which can be made from aluminum, and have a cross-sectional profile, which is shown in FIG. 4. Open ends 46 of the seat portion secondary side members 40 are shown in FIGS. 4 and 5 to illustrate details of the cross-sectional profile, but each backrest portion secondary side member 50 has the same cross-sectional profile. In this example, the seat portion secondary side member 40 includes a top surface 80, a bottom surface 82, the inside surface 44, and an outside surface 84. The cross-sectional profile of the seat portion secondary side member 40 includes a sling-receiving channel, which in the illustrated embodiment is a C-shaped channel 86 having an opening 88 along the outside surface 84. Because this is an extrusion profile, it is to be understood that these profile features extend the entire length of the seat portion secondary side members 40 (and the backrest portion secondary side members 50). The C-shaped channel 86 is used to selectively anchor a side edge of a sling 90 (see FIGS. 1 and 2) to the seat portion secondary side members 40 (and the backrest portion secondary side members 50) as described in greater detail below. The sling 90 is typically made from a strong, inelastic woven textile The cross-sectional profile of the seat portion secondary side member 40 (and the backrest portion secondary side member 50) further includes an elongate fastener-receiving channel 92 having a slot 94 open at the bottom surface 82. The fastener-receiving channel 92 receives a mechanical fastener, which can be a T-bolt 104 as shown in FIGS. 5 and 6. The T-bolt 104 is used to secure the secondary frame 34 to the primary frame 12 by securing the seat portion secondary side members 40 directly to each ledge 64 using the T-bolts 104 which are received within the fastener-receiving channel 92 as shown in FIG. 5. Each T-bolt 104 includes a threaded shank 106 and a head 108 shaped to fit within the fastener-receiving channel 92. The shape of the head 108 is sized to allow the T-bolts 104 to slide linearly within and along the fastener receiving-channel 92, but to inhibit axial rotation within the fastener receiving-channel 92 and to also limit movement parallel with a central axis of the threaded shank 106. This allows each T-bolt 104 to slide along the length of the seat portion secondary side member 40 to a desired position, e.g., where the T-bolts 104 align with respective mounting slots 68 in the ledges 64, and later tighten a threaded nut 112 (FIG. 6) onto the threaded shank 106 of each T-bolt 104, or to remove threaded nut 112 therefrom, without having to hold the head 108 of the T-bolt 104.

The elongated shape of mounting slots 68, which is elongate along a longest dimension of the seat portion secondary side member 40, and the fastener-receiving channel 92 having the slot 94 open at the bottom surface 82 allows for considerable longitudinal and rotational adjustment of the secondary frame 34 with respect to primary frame 12 during assembly. This adjustment allows the assembly of components to accommodate for slight manufacturing inaccuracies and other tolerances. Until the T-bolts 104 and the nuts 112 are tightened, the secondary frame 34 is movable with respect to the primary frame 12 on the ledge 64. This arrangement allows for quicker and easier assembly because the secondary frame 34 may be positioned onto and supported by the ledge 64 while T-bolts 104 are aligned with mounting slots 68. Conventional sub-frame assemblies are secured to their respective conventional frames using horizontally (per the orientation when the conventional chaise lounge is in the use position) disposed bolts secured directly into threaded inserts of the side members of the frame, with no supporting ledges used. Also, as the horizontal bolts of conventional chaises are tightened, the sub-frame assembly may be distorted, as the bolts apply lateral tension. In contrast, the ledge 64, as in the illustrated embodiment, provides the support for the secondary frame 34 and the vertically (per the orientation when the chaise lounge 10 is in the use position) disposed threaded shank 106 of each T-bolt 104 will not laterally strain, or otherwise deform the secondary frame 34. Accordingly, a mechanical fastener, which is the T-bolt 104 in the illustrated embodiment but could be another similar bolt, securing the secondary frame 34 to the ledge 64 includes a portion, e.g. the threaded shank 106, extending through the mounting slot 68 in a direction parallel with a gravitational force being applied on the ledge 64 by the respective seat portion secondary side member 40 when the seat portion secondary side member 40 is supported by the ledge 64. Also, the gravitational force being applied on the ledge 64 by the seat portion secondary side member 40 results in a normal stress in a cross section of the threaded shank 106 extending through the mounting slot 68 taken normal to a direction of the gravitational force.

Figure 7:
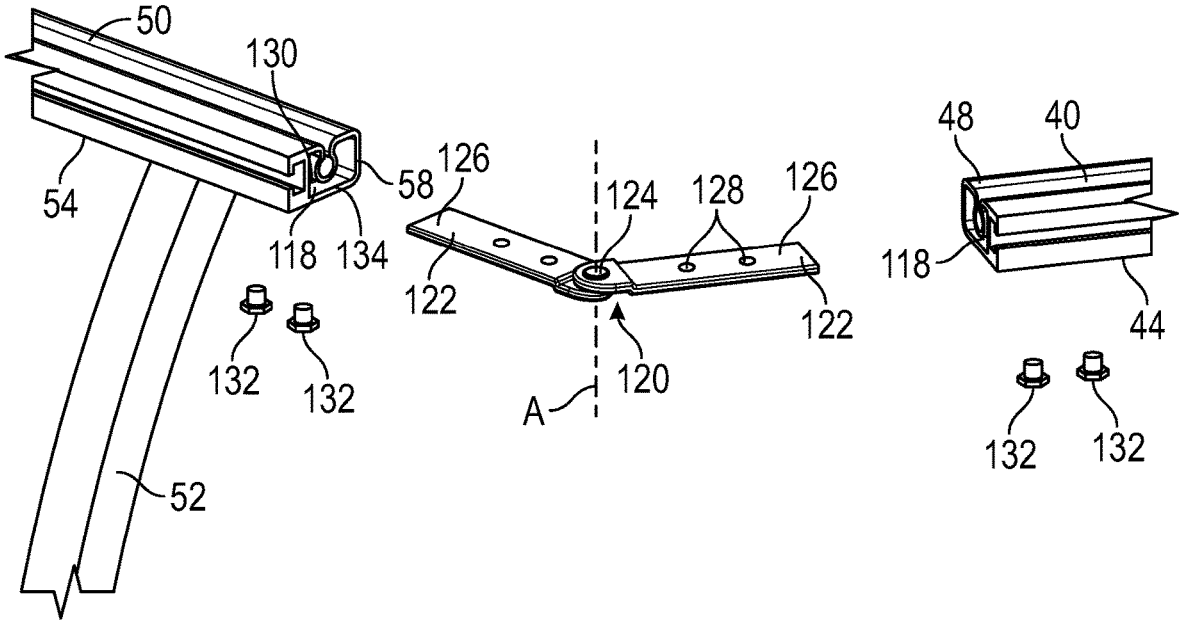
FIG. 7 perspective assembly view of a hinge assembly for the chaise lounge of FIG. 1.
Figure 8:
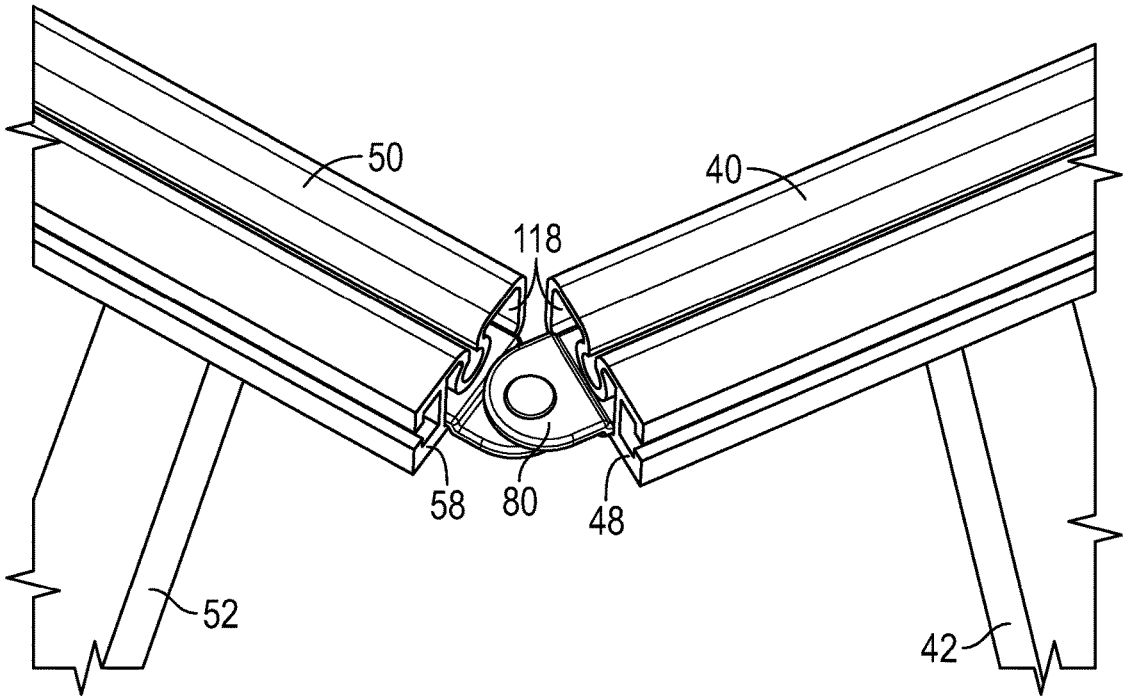
FIG. 8 is another perspective assembly view of the hinge assembly shown in FIG. 7.

With reference to FIG. 7, the cross-sectional profile of each of the secondary side members 40, 50 further includes a hollow space 118, which is used to secure other components to the secondary side members 40, 50, as described below, such as hinges 120. Referring back to FIG. 3, and according to the illustrated embodiment, two hinges 120 are used to connect each hinge end 48 of a respective seat portion secondary side member 40 to a respective hinge end 58 of a respective backrest portion secondary side member 50 in a pivotal manner. As best shown in FIG. 7, an example of a hinge 120 is shown including two nut plates 122, which can be elongate and made from metal, connected to each other by a pivot pin 124 (e.g., a rivet) along a pivot axis A. Each nut plate 122 of each hinge 120 can be identical to each other and each free end 126, which is opposite of the pivot pin 124, is sized and shaped to snugly fit within the hollow space 118 of each secondary side member 40, 50 at each respective hinge end 48, 58 as shown in FIG. 8. Each nut plate 122 further includes at least one threaded bore 128, which extends through the metal plate parallel to the pivot axis A. Each secondary side member 40, 50 includes at least one bore 130 (only one visible in FIG. 7) extending into the hollow space 118 from the respective inside surface 44, 54, and which aligns with the at least one threaded bore 128 when the respective nut plate 122 is fully inserted into the hollow space 118 of each respective secondary side member 40, 50.

To attach the hinge 120 to the hinge ends 48, 58 of the secondary side members 40, 50, one inserts the nut plate 122 of the hinge 120 into the hollow space 118 of the secondary side members 40, 50. Once inserted, the threaded bores 128 align with bores 130. To secure the hinge 120, bolts 132 are inserted into respective bores 130 to engage with threaded bores 128 of the nut plate 122. When the bolts 132 are tightened, the nut plate 122 of the hinge 120 becomes clamped against an internal wall 134 of each secondary side member 40, 50. This clamping action generates mechanical friction which ensures a firm securement of the hinge 120 to the secondary side members 40, 50. Over time, should the hinge 120 fail, through fatigue, corrosion, or otherwise require replacement, a new hinge may easily be installed, by simply removing the bolts 132 using an appropriate wrench, or other tool. To assemble the seat portion 36 of the secondary frame 34 to the backrest portion 38, the hinge 120 is secured to each hinge end 48, 58.

To secure the secondary frame 34 to the primary frame 12, the head 108 of at least one T-bolt 104 is inserted into the fastener-receiving channel 92 of the open end 46 of each seat portion secondary side member 40 and the at least one T-bolt 104 is slid along the length of each seat portion secondary side member 40 until the T-bolt 104 aligns with at least one mounting slot 68 of each respective ledge 64. With primary frame 12 positioned upright, i.e., in the position of typical use for the chaise lounge 10 when finally assembled, the seat portion 36 of the secondary frame 34, oriented with curved cross members 42, 52 facing down, is lowered onto both ledges 64 and adjacent the front end of the primary frame 12. The seat portion 36 may be adjusted longitudinally and laterally, until the threaded shanks 106 of each of the T-bolts 104 aligns with and is received by a respective mounting slot 68, causing the secondary frame 34 to rest on, and be supported by, the ledges 64. The nuts 112 are then secured to the threaded shank 106 of each T-bolt 104 and tightened with an appropriate tool, such as a wrench. The seat portion 36 is now secured to the primary frame 12.

Although only a single T-bolt 104 and nut 112 is required on each seat portion secondary side member 40 to secure the seat portion 36 to primary frame 12, it is preferred that two or more T-bolts and nuts are used along each side extrusion. Alternatively, although not shown in the figures, other types of fasteners may be used to secure the seat portion 36 to the primary frame 12, such as powerful (N52 strength) Neodymium rare earth magnets, registration pins, over-center type latches, and even rubber straps. The purpose of using removable fasteners here, such as the T-bolts 104 and the nuts 112, instead of welding the seat portion 36 to the primary frame 12, is to allow for quick and easy removal and repair the different components of chaise lounge 10. As such, sustainability is achieved because the chaise lounge 10 allows for the owner to repair and refresh their chaise lounge so that the original purchased chaise lounge may have a prolonged service life.

This arrangement allows the backrest portion 38, when assembled and operating, to pivot between a fully flat position, as shown in FIG. 1, and a fully raised position, as shown in FIG. 2, relative to the primary frame 12. This ensures that backrest portion 38 remains properly and accurately aligned with respect to seat portion 36. Many conventional chaise lounges pivotally attach the conventional backrest directly to a frame using two bolts, secured into two respective threaded inserts. This conventional method is prone to misalignment during manufacture and assembly, and prone to breaking and wearing out, relatively soon after use. It has been recognized that most of the components of conventional chaise lounges are typically welded together and that alignment errors are not uncommon. By using the assembly method and components described herein, the components that make up the chaise lounge 10 are more likely to be aligned when assembled, and more likely to remain aligned during use.

When the seat portion 36 is bolted to the primary frame 12, as discussed above, the backrest portion 38 will automatically align with primary frame 12 and be pivotal between the fully flat and fully inclined range of motion. A brace assembly 150 is used to support the backrest 24 to any of several pre-established angles of incline, with respect to primary frame 12 and the seat 26.

The brace assembly 150 includes a horizontal engagement bar 152, defining opposing engagement ends 154 (only one visible in FIG. 2) and two parallel support struts 156. Each support strut 156 is attached to the horizontal engagement bar 152 near each respective engagement end 154 a predetermined distance therefrom. The distance measured between the support struts 156 is generally close to, but less than the distance between the backrest portion secondary side members of the backrest portion 38 (see FIG. 3). The support struts 156 are preferably secured to the horizontal engagement bar 152 using an appropriate welding process.

Figure 9:
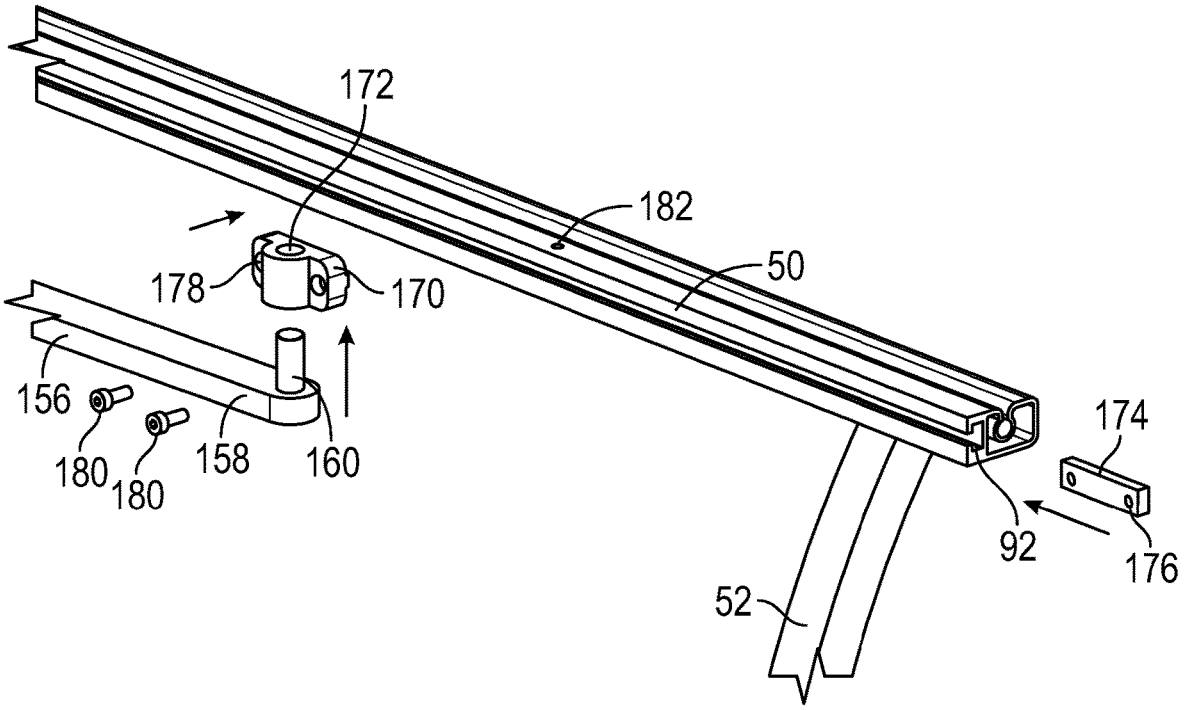
FIG. 9 is perspective partial assembly view of one backrest portion secondary side member of the chaise lounge of FIG. 1 showing assembly details of a pivot mount of a brace assembly.
Figure 10:
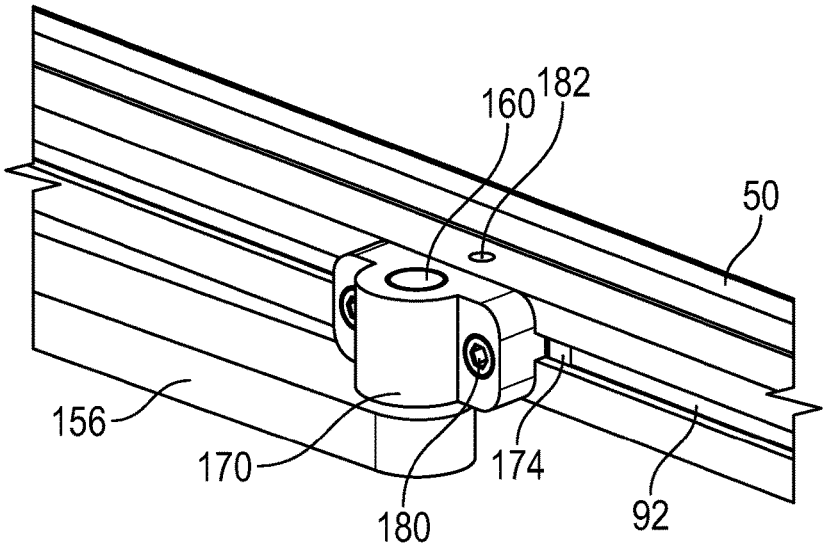
FIG. 10 is an assembled view of the pivot mount of the brace assembly shown in FIG. 9.

With reference to FIG. 9, a pivot end 158 of each support strut 156 includes a pivot pin 160 that projects outwardly and parallel to the horizontal engagement bar 152. The brace assembly 150 is pivotally attached to pivot mounts 170 at predetermined locations along each backrest portion secondary side member 50. Each pivot mount 170 includes a pivot bore 172 which is sized and orientated to receive a respective pivot pin 160. Each pivot mount 170 is secured at a prescribed location along each backrest portion secondary side member 50 so that pivot bores 172 axially align with each other and allow selective pivotal displacement of the brace assembly 150, wherein the horizontal engagement bar 152 may be manually rotated about the pivot pins 160, to a desired angular position. Each pivot mount 170 is secured to a pivot mount plate 174 located within each respective fastener-receiving channel 92 of each respective backrest portion secondary side member 50. Each pivot mount plate 174 includes at least one, but preferably two threaded bores 176, which align with two bores 178 of each pivot mount 170. In use, each pivot mount plate 174 is slid into each respective fastener-receiving channel 92, as shown in FIG. 9, and positioned at a predetermined location. Each respective pivot mount 170 is positioned in alignment with each respective pivot mount plate 174 so that the respective bores 178 align with the respective threaded bores 176. Pivot mount fasteners 180 are used to secure each pivot mount 170 to each respective pivot mount plate 174. As the pivot mount fasteners 180, which can be conventional bolts, are tightened, each pivot mount 170 is firmly secured to each backrest portion secondary side member 50. The predetermined and correct location of each pivot mount 170 may be indicated using a mark 182 located on each backrest portion secondary side member 50, as shown in FIGS. 9 and 10. Each pivot mount 170 may be selectively loosened and repositioned along the length of each respective backrest portion secondary side member 50, and removed, if necessary, for cleaning or replacement. The brace assembly 150 is mounted to the underside of backrest portion 38, as described above, so that each engagement end 154 projects into and engages with any of engagement teeth 76 of each respective ratchet 74 (see FIG. 3). When select engagement teeth 76 engage with the horizontal engagement bar 152, the brace assembly 150 will be held at a specific angle, which, in turn, will hold the backrest 24 at a specific angle, with respect to the seat 26.

Open weave textile slings are often used in conventional chaise lounges to provide a firm and quickly-drying support surface for an occupant of the conventional chaise lounge. Such conventional slings are precisely cut to fit within a specific supporting frame and include an elongate hemmed pocket formed along two opposing edges. Each hemmed pocket is slid into a slot provided by conventional chaise frame sides. A rod is then inserted into each hemmed pocket. The rod has a sectional size that is greater than the size of the slot so that the rod effectively retains the hemmed pocket within the frame structure, and thereby also secures the opposing edges of the textile sling across the conventional frame. One problem with textile slings used with conventional chaise lounges is that there is no way to tighten or easily replace the sling, should the sling begin to sag over time, or become damaged. In such instance, an owner's options would include trying to replace the sling, using a relatively complicated process and uncommon tools, and consider replacing the entire chaise lounge.

Figure 11:
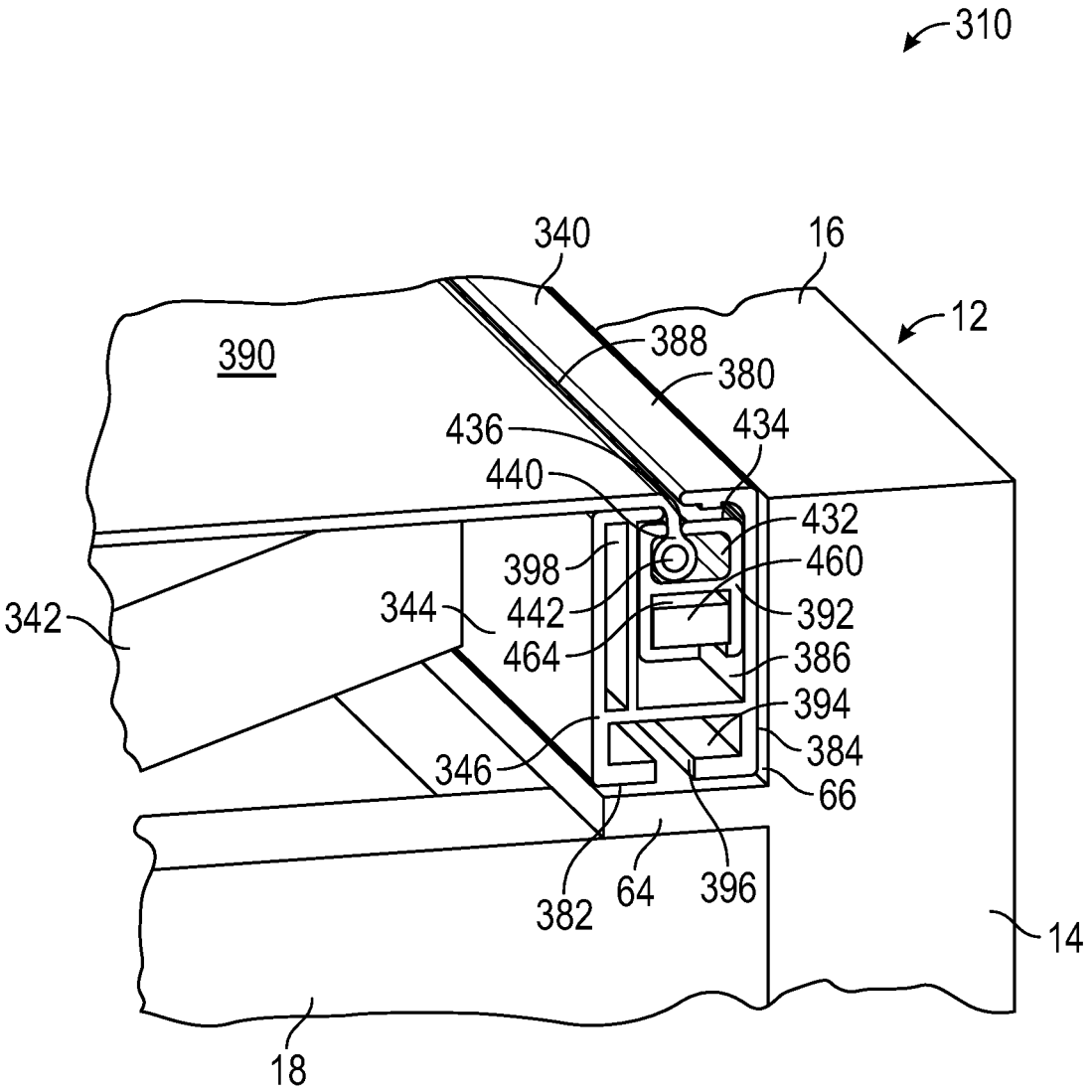
FIG. 11 is a perspective partial view of a right front end of a chaise lounge similar to that shown in FIG. 1 showing details of a sling tensioning system in a first position.

With reference to FIG. 11, a partial end view of chaise lounge 310 is shown. The chaise lounge 310 is similar to the chaise lounge 10 described above in that it includes the primary frame 12, which is shown in FIG. 3. In FIG. 11, only one corner of the primary frame 12 is shown which includes one primary side member 16, one leg 14 and one primary cross member 18. The ledge 64 projecting perpendicularly from the inside surface 66 of the primary side member 16 is also shown in FIG. 11.

Figure 12:
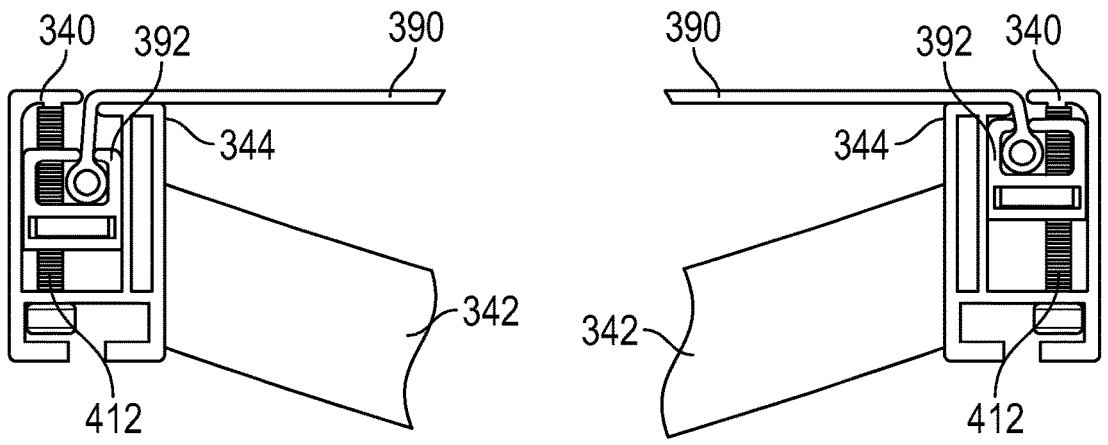
FIG. 12 is an end view with sections broken away showing the sling tensioning system depicted in FIG. 11 on both sides of the chaise lounge.

The chaise lounge 310 further includes a secondary frame (only a portion of which is shown in FIG. 11) that includes a seat portion and a pivotally attached backrest portion similar to the secondary frame 34 shown in FIG. 3. The secondary frame of the chaise lounge 310 differs from the chaise lounge 10 described above in the cross-sectional profile of the secondary side members. FIG. 11 depicts one seat portion secondary side member 340 having a particular cross-sectional profile, and the other seat portion secondary side member 340 (see FIG. 12) and the backrest portion secondary side members (not shown, but similar to the backrest portion secondary side members 50 described above) of secondary frame of the chaise lounge 310 have the same cross-sectional profile. FIGS. 11 and 12 also depict a seat portion secondary cross member 342 secured to an inside surface 344 of one seat portion secondary side member 340. The seat portion secondary cross member 342 extends across to connect the seat portion secondary side members 340 in a similar manner to the seat portion secondary cross member 42 described above.

With particular reference to FIG. 11, an open end 346 of the seat portion secondary side member 340 is shown to illustrate details of the cross-sectional profile. The seat portion secondary side member 340 includes a top surface 380, a bottom surface 382, the inside surface 344, and an outside surface 384. The cross-sectional profile of the seat portion secondary side member 340 includes a sling anchor-receiving channel 386, which in the illustrated embodiment is rectangular in the cross section. The cross-sectional profile of the seat portion secondary side member 340 further includes a sling-receiving slot 388 leading to the sling anchor-receiving channel 386. In the embodiment illustrated in FIG. 11, the sling-receiving slot 388 is provided in the top surface 380. Because this is an extrusion profile, it is to be understood that these profile features extend the entire length of the seat portion secondary side members 340 (and the backrest portion secondary side members, which are not shown but similar to the backrest portion secondary side members 50). The sling anchor-receiving channel 386 is used to selectively anchor a sling 390 to the seat portion secondary side member 340 through the use of a sling anchor 392 as described in greater detail below, and it is to be understood that a similar sling could be connected with the backrest portion secondary side members, which are not shown, in a similar manner.

The cross-sectional profile of the seat portion secondary side member 340 further includes an elongate fastener-receiving channel 394 having a slot 396 open at the bottom surface 382. The fastener-receiving channel 394 receives a mechanical fastener, which can be the T-bolt 104 as shown in FIGS. 5 and 6. The T-bolt 104 is used to secure the secondary frame to the primary frame 12 by securing the seat portion secondary side members 340 directly to each ledge 64 using the T-bolts 104 in the manner described above with reference to FIGS. 4-6. The fastener-receiving channel 394 is offset from the sling anchor-receiving channel 386, and as illustrated is offset below the sling anchor-receiving channel 386. The cross-sectional profile of the seat portion secondary side member 340 further includes an elongate hinge-receiving channel 398, which can receive a hinge 120 (see FIGS. 7 and 8) to pivotally attach one seat portion secondary side member 340 to a respective backrest portion secondary side member in a similar manner to that shown in FIGS. 7 and 8.

Figure 13:
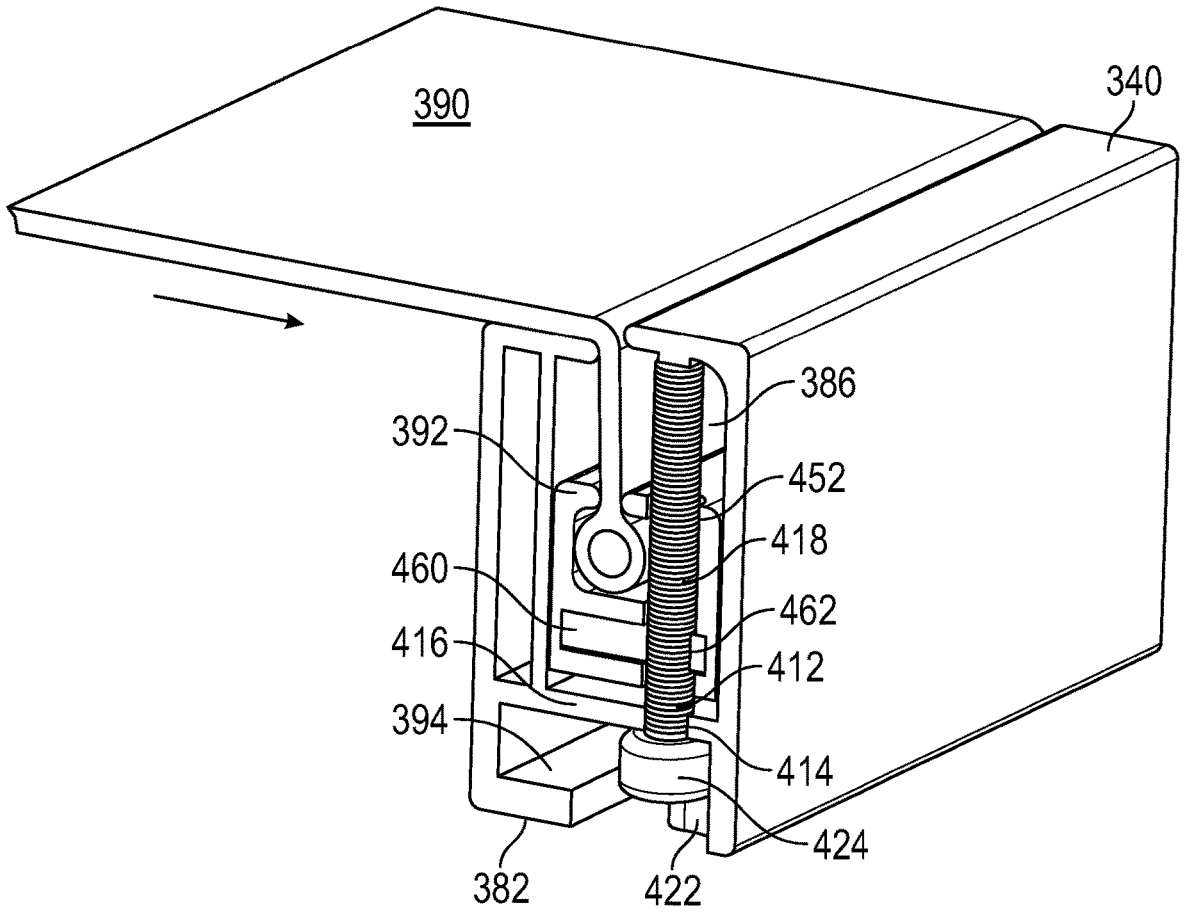
FIG. 13 is a perspective partial sectional view of the right front end of the chaise lounge chair shown in FIG. 11 showing details of the sling tensioning system in a second position.

The sling anchor 392 connects with the seat portion secondary side member 340 and is movable with respect to the primary frame 12 and the seat portion secondary side member 340. With reference to FIGS. 12 and 13, a threaded fastener 412 engages the sling anchor 392 and the seat portion secondary side member 340. Rotation of the threaded fastener 412 with respect to the sling anchor 392 and the seat portion secondary side member 340 results in movement of the sling anchor 392 with respect to the seat portion secondary side member 340, which results in movement of the sling 390 with respect to the seat portion secondary side member 340. The sling anchor 392 is movable within the sling anchor-receiving channel 386 with respect to the seat portion secondary side member 340 in a direction perpendicular to the longest dimension of the seat portion secondary side member 340 in response to rotation of the threaded fastener 412. With reference to FIG. 13, a bore 414 located at a prescribed location along a horizontal internal wall 416 receives a threaded shank 418 of the threaded fastener 412. The horizontal internal wall 416 separates the fastener-receiving channel 394 from the sling anchor-receiving channel 386. An appropriate cutout 422 may be provided extending internally from the bottom surface 382, so that a head 424 of the threaded fastener 412 may be recessed within the seat portion secondary side member 340 as shown in FIG. 13.

With reference to FIG. 12, the sling 390 is positioned between the seat portion secondary side member 340 and secured thereto, as described in greater detail below. A similar sling 390 is also positioned between backrest portion secondary side members and secured in a similar manner. The sling 390 is typically made from a strong, inelastic woven textile.

The sling anchor 392 is sized and shaped to fit within the sling anchor-receiving channel 386. The width of the sling anchor 392 is slightly less than the width of the sling anchor-receiving channel 386 so that the sling anchor 392 may freely slide up and down (per the orientation shown in FIG. 12) therein. The height of the sling anchor 392 is preferably approximately half the height of sling anchor-receiving channel 386 so that the sling anchor 392 may slide a meaningful distance within the sling anchor-receiving channel 386. The greater the distance of vertical displacement of the sling anchor 392 within the sling anchor-receiving channel 386, the greater the sling 390 may be tensioned between the seat portion secondary side members 340 (and the backrest portion secondary side members). The sling anchor 392 may move within the sling anchor-receiving channel 386 between a raised position, as shown in FIG. 11, and a lowered position, as shown in FIG. 13. The sling anchor 392 is preferably made from an extruded aluminum and defines a sling-receiving channel 432, an upper surface 434, and a sling-receiving slit 436 providing access to the sling-receiving channel 432. When the sling anchor 392 is properly positioned within the sling anchor-receiving channel 386, the sling-receiving slit 436 of the sling anchor 392 aligns with the sling-receiving slot 388 of the seat portion secondary side member 340 so that a portion of the sling 390 may pass through the sling-receiving slit 436 and the sling-receiving slot 388 with an edge 440, which can be a hemmed pocket, of the sling 390 received within the sling-receiving channel 432 along with an anchor rod 442. The diameter (or cross-sectional dimension) of the anchor rod 442 is greater than the width of the sling-receiving slit 436 so that when the anchor rod 442 is received in the hemmed pocket at the edge 440, the edge 440 is retained in the sling-receiving channel 432. The diameter (or cross-sectional dimension) of the anchor rod 442 can also be greater than the width of the sling-receiving slot 388.

With reference to FIG. 13, a threaded bore 452 is provided through a side portion of the sling anchor 392 and aligns with the bore 414 in the horizontal internal wall 416 so that the threaded shank 418 of the threaded fastener 412 may reside within the bore 414 and the threads of the threaded shank 418 may engage with the threaded bore 452. This arrangement allows selective rotation of the threaded fastener 412 to mechanically raise or lower the sling anchor 392 between its raised and lowered positions. Because the edges 440 of the sling 390 are secured within respective sling receiving channels 432, controlled vertical displacement of the sling anchor 392 using the threaded fastener 412 tightens and loosens the sling 390. In use, a repair person may use a tool, such as an Allen wrench (not shown) to rotate the threaded fastener 412 counter-clockwise to loosen the sling 390, so that the tension is reduced sufficiently to longitudinally remove the anchor rod 442, and thereby allow the edge 440 to be removed from the sling-receiving slit 436 and the sling-receiving slot 388. Similarly, the repair person may the threaded fastener 412, by rotating it clockwise, to pull the sling anchor 392 down within the sling anchor-receiving channel 386, thereby effectively tightening the sling 390, which may, for example, be sagging.

Due to the magnitude of tension when tightening the sling 390, the threaded fastener 412 may be made from steel. The threaded bore 452 located within the sling anchor 392, which may be made from aluminum, may not be strong enough to withstand the force of tension caused by a taut sling and may strip during tightening. To strengthen the threaded engagement between the threaded fastener 412 and the sling anchor 392, a steel insert 460 having a threaded hole 462 may be provided. The threaded hole 462 is sized, shaped, and positioned to engage the threaded shank 418 of the threaded fastener 412. Using the threaded fastener 412, which can be made from steel, and a steel insert 460, sufficient engagement strength can be provided to generate the tension required for the sling 390 to provide support for an occupant during normal use of chaise lounge 310. To accommodate the steel insert 460, the sling anchor 392 may include a rectangular lower channel 464 into which the steel insert 460 may be positioned. The steel insert 460 may be provided in the form of an elongated bar of steel which is shaped to fit within the rectangular lower channel 464, with a length generally equal to that of the seat portion secondary side member 340. The threaded hole 462 would be formed at prescribed points along the length of the steel insert 460 so that each threaded hole 462 aligns with each threaded fastener 412 located along the seat portion secondary side member 340. If a steel insert 460 is used, the aforementioned threaded bore 452 will be made with a diameter which is slightly larger than the diameter of the threaded shank 418 and likely no longer be threaded so that the threaded shank 418 will not directly engage with the sling anchor 392, but indirectly by engaging the steel insert 460, which, in turn, will pull or push the sling anchor 392 during rotation of the threaded fastener 412.

In use, as shown in FIG. 13, as the threaded fastener 412 is rotated clockwise, the threads of the threaded shank 418 will engage with the threads of the threaded hole 462 in the steel insert 460 and will force the steel insert 460 down within the sling anchor-receiving channel 386. This movement will also pull the sling anchor 392 down, which, in turn, will also pull down the attached sling 390. As the sling 390 is pulled down vertically within the sling anchor-receiving channel 386, the tension of the sling 390 across the parallel and spaced seat portion secondary side members 340 will increase, as illustrated by the arrows of FIG. 13. Alternatively, a barrel nut (not shown) may be used at each bolt location in place of the steel insert 460. This would allow each threaded fastener 412 to pivot a slight amount during tightening of sling anchor 392. In another alternative arrangement, the sling anchor 392 can include aluminum filling the void provided by the rectangular lower channel 464 and this relatively thicker section of material can include the threaded bore 452, which may very well be adequate to sustain the forces being applied when tensioning the sling 390. As such, the sling anchor 392 can include a thickened section of material, which can be aluminum or steel, disposed beneath the sling-receiving channel 432 (per the orientation when the chaise lounge is in use) that is at least one-half the height of the sling-receiving channel 432. The threaded fastener 412 engages this thickened section of material, which can include the steel insert 460, the aforementioned barrel nut, and aluminum filling the void provided by the rectangular lower channel 464 to provide an adequate section of material to sustain the forces being applied when tensioning the sling 390.

If desired, the sling anchor 392 and the steel insert 460 (if provided) may be segmented within the respective seat portion secondary side members 340. By providing separate segments of the sling anchor 392 and the steel insert 460 (if provided), this arrangement would allow different areas of the sling 390 to be tightened, independent of other areas. This arrangement may be particularly beneficial to outdoor chaise lounges since during prolonged use, certain areas of sling 390 tend to sag before other areas, such as the area under an occupant's midsection. Similarly, both the sling anchor 392 and the sling 390 may be equally segmented, where each distinct segment of the sling anchor 392 connects with distinct segment of the sling 390. This arrangement would allow specific individual sling segments to be tightened, retightened and even replaced, independent of the other sling segments of the chaise lounge. Also, the type of material, the amount of padding, the amount of bounce, and other characteristics may be selected specific to each particular segment. For example, the sling segment located on the seat portion adjacent to the backrest portion (the segment that the occupant sits on) may be provided with a thicker padding to provide comfort to the occupant during use.

Figure 14:
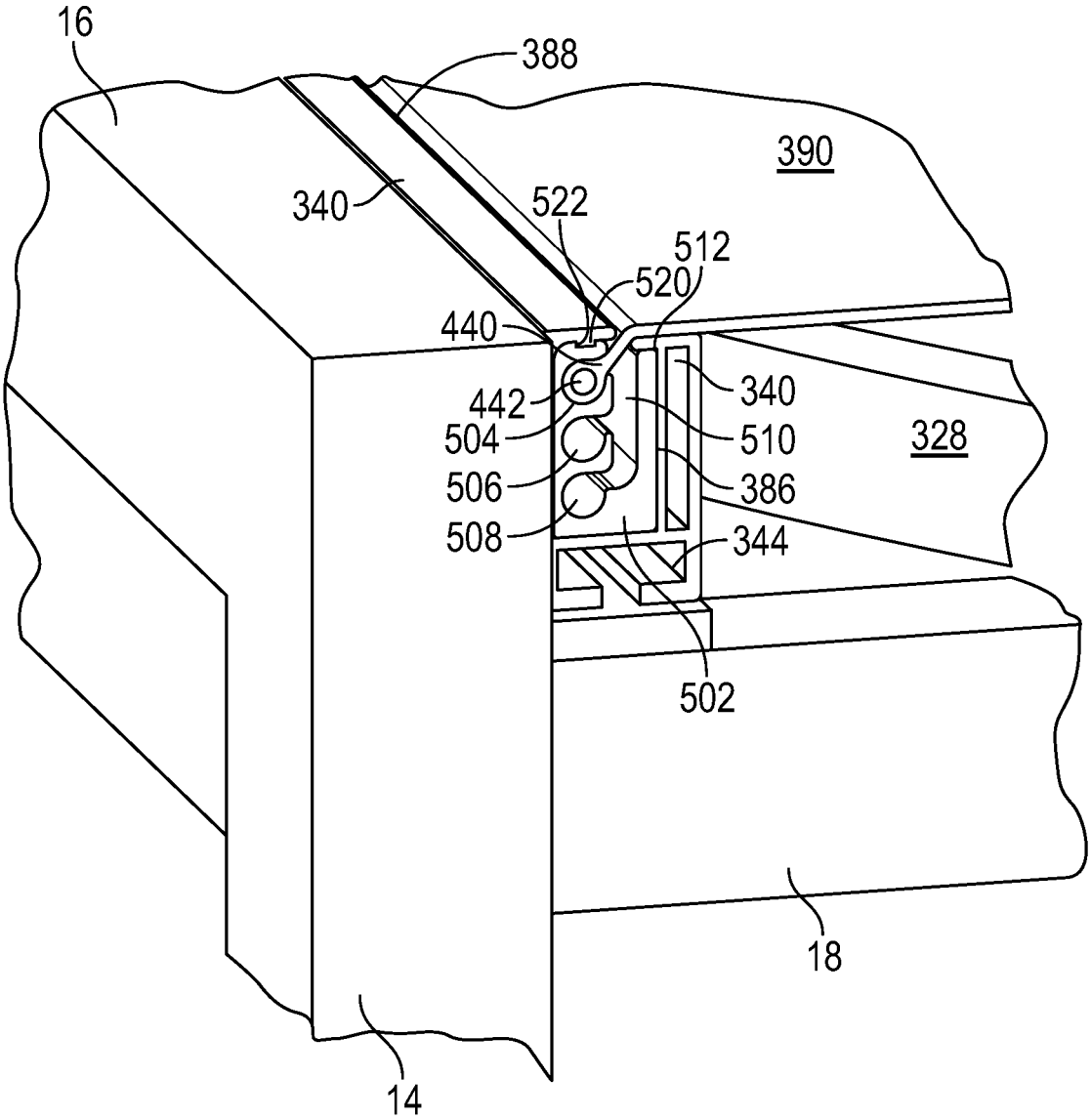
FIG. 14 is a perspective partial view of a left front end of a chaise lounge similar to that shown in FIG. 1 showing details of an alternative sling tensioning system.

With reference to FIG. 14, an alternative (or second) sling anchor 502 is shown connected with one seat portion secondary side member 340, e.g., on the left side of the chaise lounge 310. The alternative sling anchor 502 can be an elongate extrusion made from either plastic or aluminum and is sized and shaped to snuggly fit into the sling anchor-receiving channel 386. The alternative sling anchor 502 is generally equal to the length of sling 390 and includes an upper sling edge receiving channel 504, a middle sling edge receiving channel 506 and a lower sling edge receiving channel 508. In the illustrated embodiment, a plurality of sling edge receiving channels are provided, but a single sling edge receiving channel to still function properly. Each of the upper sling edge receiving channel 504, the middle sling edge receiving channel 506 and the lower sling edge receiving channel 508 is connected to a passage 510 which extends to and opens at an upper surface 512 of the alternative sling anchor 502 and aligns with the sling-receiving slot 388 of the seat portion secondary side member 340. Each of the upper sling edge receiving channel 504, the middle sling edge receiving channel 506 and the lower sling edge receiving channel 508 is configured to receive an edge 440, which can be a hemmed pocket, of the sling 390. The edge 440 may be inserted into any one of the upper sling edge receiving channel 504, the middle sling edge receiving channel 506 and the lower sling edge receiving channel 508 and then the edge 440 can be locked in place by inserting the anchor rod 442 into the hemmed pocket.

In use, when the sling 390 is first installed, the sling 390 will be tight and cut to a width that matches the distance between the upper sling edge receiving channel 504, for example on the left side of the chaise lounge 310, and the sling-receiving channel 432, for example on the right side of the chaise lounge 310, when the sling anchor 392 is located at the raised position, as shown in FIG. 11. During use of the chaise lounge 310, the sling 390 will begin to sag and stretch out, causing the effective sling width to increase. A person may then tighten up the slack of the sling 390 by tightening each threaded fastener 412, as described above, so that sling anchor 392 will move from the raised position toward the lowered position and become taut once again.

During continued use, the sling 390 may again become loose, but the sling anchor 392 may not move any further down because it may be located at the lowered position, as shown in FIG. 13. An operator may rotate each threaded fastener 412 to raise the sling anchor 392 back to its raised position, and then reposition the opposing edge 440 of the sling 390 from the upper sling edge receiving channel 504 to the middle sling edge receiving channel 506. Since the middle sling edge receiving channel 506 is located below the upper sling edge receiving channel 504, moving the edge 440 to this new location will effectively tighten the sling 390. With the edge 440 anchored in the middle sling edge receiving channel 506, the sling anchor 392 may be tightened a bit to bring the sling 390 back to a desired tension. Additional use may cause additional sagging and the lower sling edge receiving channel 508 may have to be used.

An elongate ridge 520 can be provided in the seat portion secondary side member 340 and project downward into the sling anchor-receiving channel 386. The elongate ridge 520 aligns with an elongate notch 522 formed into the upper surface 512 of the sling anchor-receiving channel 386. When the alternative sling anchor 502 is positioned within the sling anchor-receiving channel 386, the elongate ridge 520 engages within the elongate notch 522. This engagement inhibits lateral movement of the alternative sling anchor 502 within the sling anchor-receiving channel 386 caused by the laterally-directed tension of sling 390. The alternative sling anchor 502 is shown as a separate component that is sized and shaped to snuggly fit within the sling anchor-receiving channel 386; however, the alternative sling anchor 502 may also be integrally-formed with the seat portion secondary side member 340, if desired.

Figure 15:
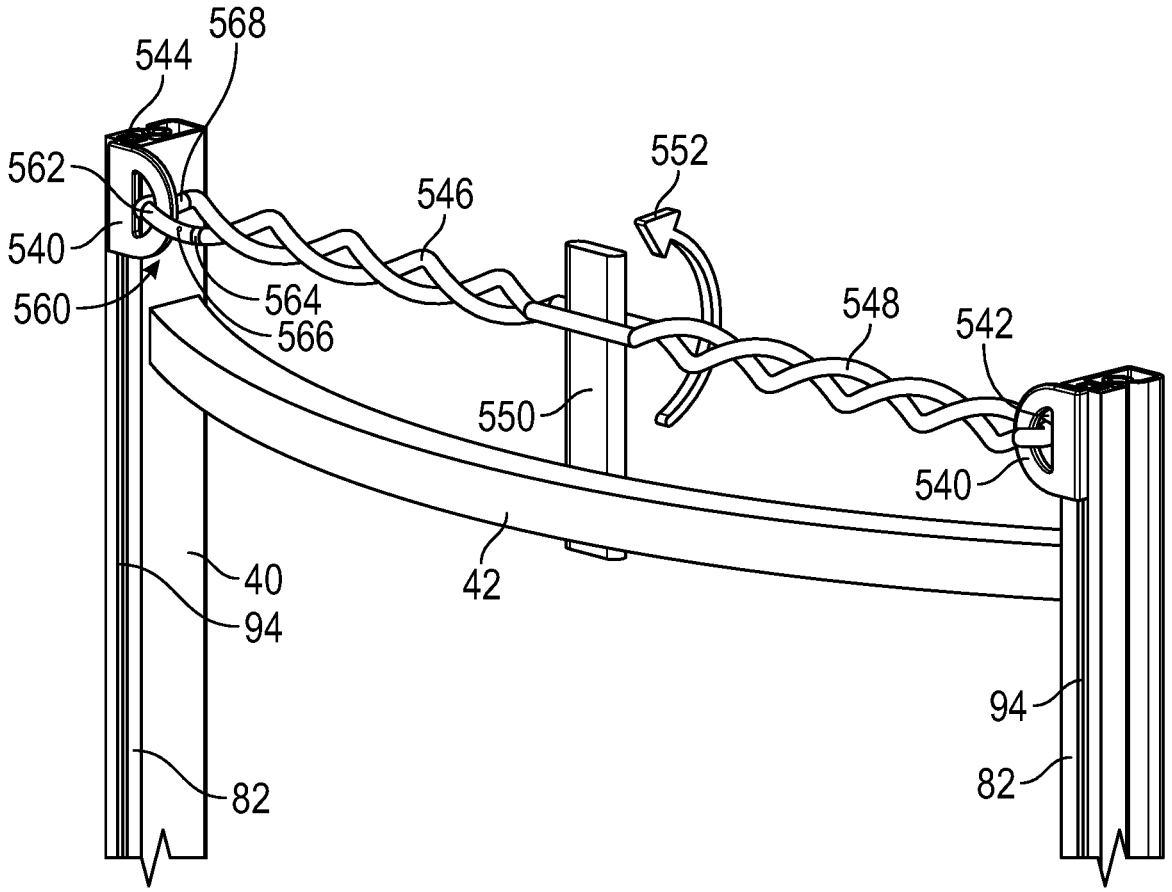
FIG. 15 is a perspective partial view of the secondary frame shown in FIG. 3 showing details of a system and method for removing or installing a sling to the secondary frame.

FIG. 15 depicts a system and method for installing and removing the sling (see FIGS. 1 and 16) onto either the seat portion secondary side members 40 or the backrest portion secondary side members 50 shown in FIG. 3. The system and method for installing and removing the sling 90 will be described in particularity with reference to the seat portion secondary side members 40, but because the backrest portion secondary side members 50 can have the same cross section and can be formed via the same extrusion process, such that installation on and removal from the backrest portion secondary side members 50 would be the same.

With reference to FIG. 15, a bracket 540 is provided for temporary securement to each seat portion secondary side member 40. Each bracket 540 includes an eyelet 542 and a mounting section 544. In the illustrated embodiment, each mounting section 544 has a T-shaped section, which is sized and shaped to slide along the seat portion secondary side member 40 within the elongate fastener-receiving channel 92 (see FIG. 4) having the slot 94 open at the bottom surface 82. This allows for easy engagement of each mounting section 544 of each bracket 540 within the elongate fastener-receiving channel 92. In the illustrated embodiment, a plurality of pairs of brackets 540 are secured onto opposite seat portion secondary side members 40 so that the brackets 540 of each pair laterally align with each other and so that each pair of brackets are evenly spaced along the length of the secondary frame 34 (shown without the brackets in FIG. 3) preferably residing adjacent to each respective curved cross member 42, 52.

A cord 546 is connectable with and configured to span between each bracket. As illustrated in FIG. 15, the cord 546 connects with each eyelet 542 of each bracket 540 in each bracket pair. When connected with the brackets 540, the cord 546 can be provided with or twisted to form a loop 548, and preferably many loops, in a braided pattern, which is shown as a two-strand pattern in FIGS. 15 and 16 but could be a multi-strand pattern depending on the make up of the cord 546. The cord 546 can be made from a very strong material having a high tensile strength, such as a polyester braided rope.

A twisting member 550, which can be an elongate rigid bar, is positioned within a respective loop 548, as shown in FIG. 15, and rotated as shown by arrow 552 so that the cord 546 begins to twist. The twisting member 550 is configured to engage with the cord 546 and be manipulated by an operator to twist the cord 546 when the cord 546 is engaged with and spanning between the brackets 540. As the cord 546 twists, the twisted cord 546 will tighten upon itself, causing its effective length to shorten. As the length of the twisted cord 546 decreases, the twisted cord 546 will pull the seat portion secondary side members 40 towards each other. The magnitude of lateral displacement can be controlled by counting the number of rotations while twisting. The twisting member 550 may be made from wood, plastic or metal and is strong and long enough to provide sufficient leverage for the person installing or removing the sling to twist the cord 546 and pull the seat portion secondary side members 40 together, against the bias of the welded curved cross members 42. Once a desired amount of lateral displacement has been reached, the twisting member 550 may be positioned against a nearby curved cross member 52, as shown in FIG. 15, to hold and prevent the twisted cord 546 from unwinding.

When each of the twisted cords 546 are properly tightened, the seat portion secondary side members 40 will reside slightly closer to each other, which will effectively cause the sling 90 to loosen. Because the pulling force of each twisted cord 546 is applied to each respective seat portion secondary side member 40 through each respective bracket 540 and through each elongate fastener-receiving channel 92 (see FIG. 4), the sling 90 and the C-shaped channel 86 remain fully accessible so that hemmed pockets 556 at each edge of the sling 90 may be easily slid into the C-shaped channel 86 of each seat portion secondary side member 40. After the hemmed pocket 556 is fully installed into circular the C-shaped channel 86, an anchor rod 558 may be inserted into hemmed pocket 556, thereby locking the sling 90 to the seat portion secondary side member 40, as shown in FIG. 16.

Figure 16:
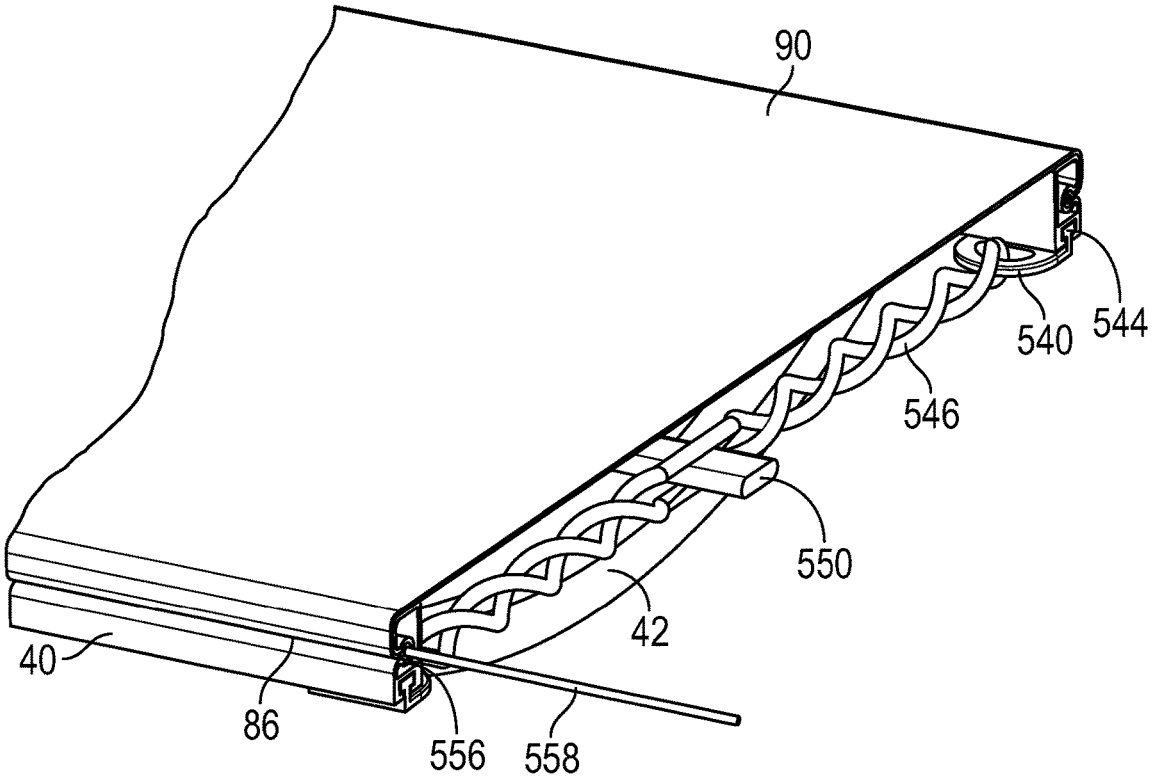
FIG. 16 is a perspective partial view of the secondary frame shown in FIG. 3 showing details of the system and method of FIG. 15 during removal or installation of the sling.

With particular reference to FIGS. 15 and 16, the cord 546 is secured to each of the seat portion secondary side members 40, which are parallel and spaced apart a first distance from each other before the cord 546 is twisted by the operator. In FIGS. 15 and 16, the cord 546 is secured to each of the seat portion secondary side members 40 through the brackets 540. The cord 546 is then twisted to draw the seat portion secondary side members 40 closer to each other so that the seat portion secondary side members 40 are spaced a second distance from each other, which is less than the first distance. The sling 90 is then removed from or attached to each of the seat portion secondary side members 40 in a manner that was just described above. The cord 546 can then be untwisted to allow the seat portion secondary side members 40 to return toward being spaced the first distance from each other.

To facilitate connection of the cord 546 to the brackets 540, a clip 560, which can operate similarly to a carabiner, can be provided at each end of the cord 546, although only one is shown in particularity in FIG. 15. The clip 540 includes a gate 562, which may be spring loaded, connected with a gate mount 564 via a rivet pin 566. The gate mount 564 is connected with an end of the cord 546. A clip frame 568 connects with another end of the cord 546 and cooperates with the gate 562 similar to how the gate and frame in a conventional carabiner cooperate with each other. The gate 562 can pivot with respect to the gate mount 564 to allow the clip frame 568 to hook around the bracket 540 within the eyelet 542 before the gate 562 pivots back to engage the clip frame 568. The clip 540 provides a simple connection of the cord 546 with the bracket 540, although other types of connections could be provided. Accordingly, at least one clip 540 can provided at one end of the cord 546, where the clip 560 is configured to selectively connect with at least one of the brackets 540.

The sling 90 may be removed from the seat portion secondary side members 40 by using the cord 546, brackets 540, and twisting member 550, as described above to squeeze the seat portion secondary side members 40 together. The anchor rod 558 may then be pulled from each hemmed pocket 556 allowing the sling 90 to be removed from the seat portion secondary side members 40.

Figure 17:
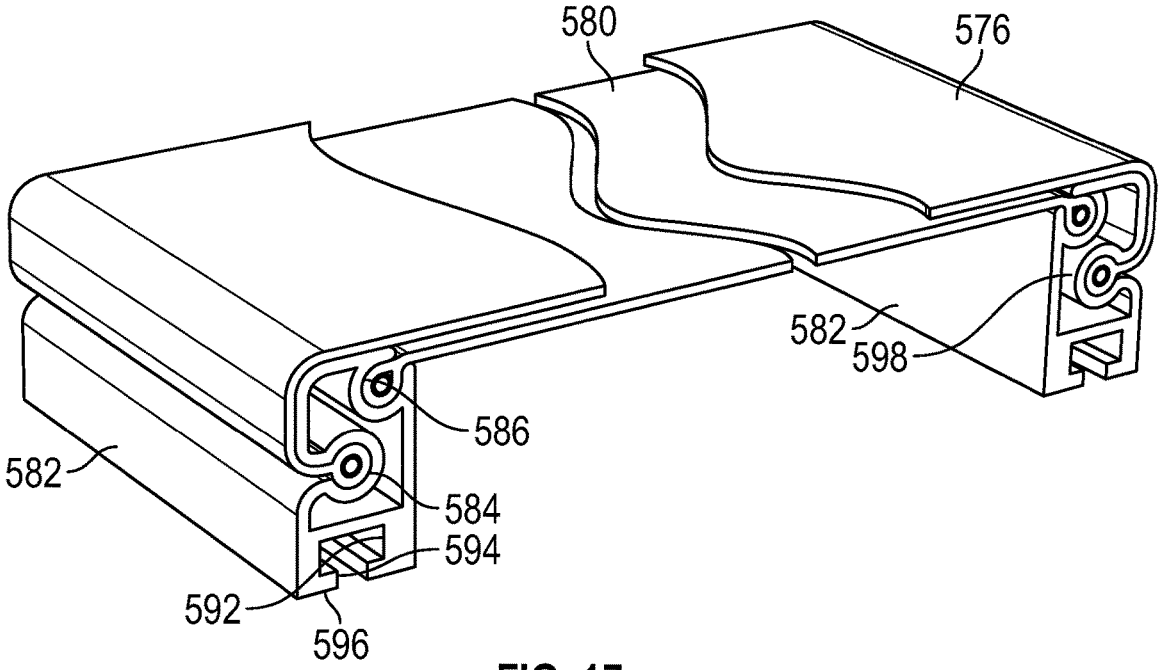
FIG. 17 is a perspective partial cutaway view of a secondary frame similar to that shown in FIG. 3 showing side members, each of which having two channels for receiving and securing two separate slings stretched therebetween.

FIG. 17 depicts a primary sling 576 and a secondary sling 580 secured to each of and spanning between side members 582, which can be similar in function to the seat portion secondary side members 40 and the backrest portion secondary side members 50 shown in FIG. 3. The side members 582 depicted in FIG. 17, however, have a slightly different cross-sectional profile than the seat portion secondary side members 40 and the backrest portion secondary side members 50 shown in FIG. 3 to allow for connection of the primary sling 576 and the secondary sling 580.

Each side member 582 includes an extrusion profile that defines a primary sling-anchor channel 584, which is sized and shaped to receive and hold opposing edges of the primary sling 576, and a secondary sling-anchor channel 586, which is sized and shaped to receive and hold opposing edges of the secondary sling 580. The secondary sling 580 is positioned generally parallel to, and a predetermined distance below the primary sling 576. The secondary sling 580 may be positioned below the entirety of the primary sling 576, or only below select areas thereof. The purpose of the secondary sling 580 is to provide secondary support to the primary sling 576, for example when the primary sling 576 is sagging due to age and/or due to an excessive load, such as when supporting a heavy person, or areas of the chaise which experience concentrated loads, such as below an occupant's midsection or hips during use. The secondary sling 580 may be made from the same material as the primary sling 576, or from a different material, such as a strong and less-elastic material.

In addition to the primary sling-anchor channel 584 and the secondary sling-anchor channel 586, the extrusion profile of each side member 582 may also include an elongate fastener-receiving channel 592 having a slot 594 open at a bottom surface 596 of the side member 582, which can be similar and shape and function to the elongate fastener-receiving channel 92 having the slot 94 open at the bottom surface 82 as depicted in FIG. 4. Additionally, the cross-sectional profile of each of side member 582 further includes a hollow space 598, which can be used to secure a hinge, such as the hinge 120 depicted in FIGS. 7 and 8. Accordingly, the side members 582 with cross members (not shown, but similar to the curved cross members 42, 52 shown in FIG. 3) can be assembled to form a secondary frame similar to the secondary frame 34 depicted in FIG. 3.

Figure 18:
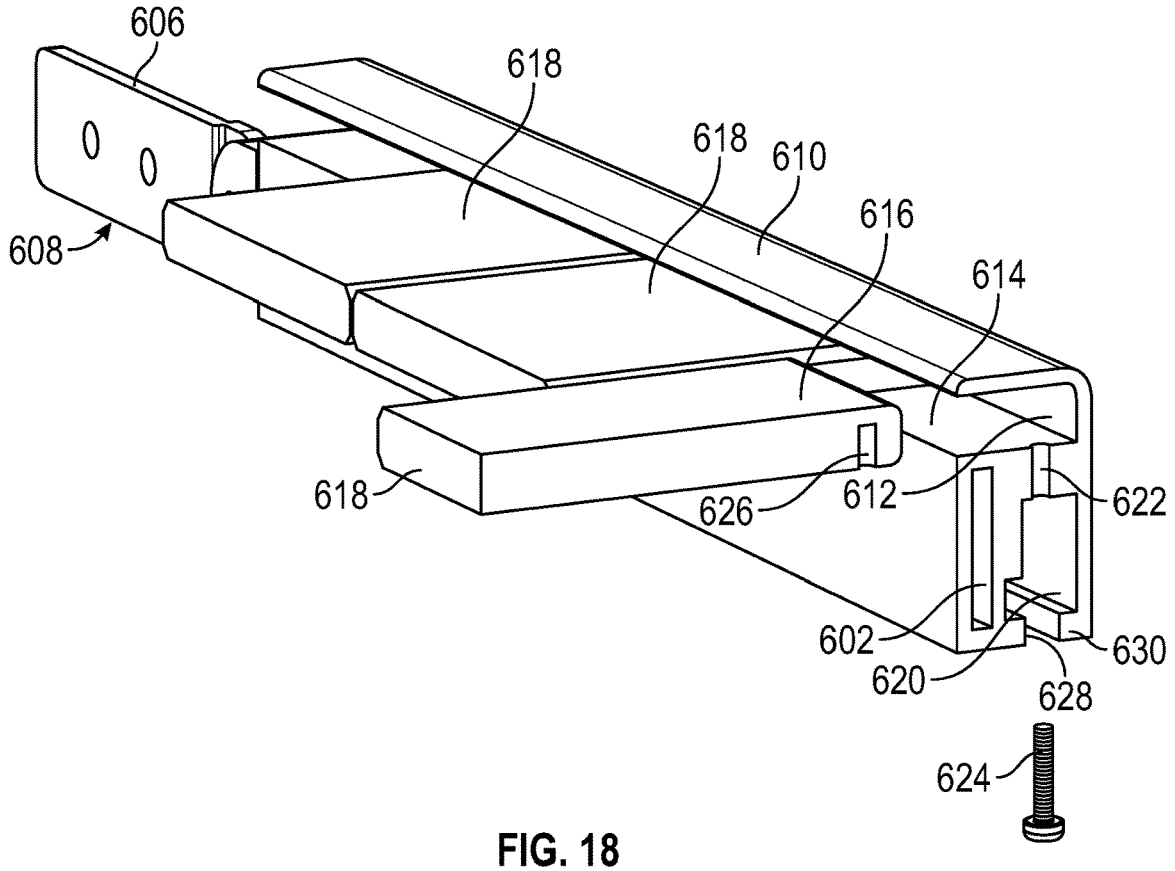
FIG. 18 is a perspective partial cutaway view of a secondary frame similar to that shown in FIG. 3 having slats instead of the sling as a support surface.

Referring now to FIG. 18, a right-side member 610, which can be similar in function to the seat portion secondary side members 40 and the backrest portion secondary side members 50 shown in FIG. 3, is shown. For clarity, only the right-side member 610 is illustrated. The left-side member would include the same structure and features. The right-side member 610 can made from an aluminum or plastic extrusion having a specific extruded profile. The right-side member 610 includes a hinge-channel 602 which is sized, shaped, and positioned to snugly receive a hinge plate 606 of a hinge 608, which may be used to connect the right-side member 610, which can be part of a seat portion similar to the seat portion 36 of the secondary frame 34 shown in FIG. 3, to another similar side member, which can be similar to the backrest portion 38 of the secondary frame 34 shown in FIG. 3. The hinge 608 is one of two hinges which can pivotally connect a backrest portion to a seat portion.

The right-side member 610 further includes an upper slat-receiving channel 612, which includes a side opening 614 that is directed towards the opposing left side member (not shown in FIG. 18). The slat-receiving channel 612 is sized and shaped to receive ends 616 of respective slats 618. The slats 618 may be made from any of a variety of materials, such as wood, plastic, metal, or laminations made from two or more different materials, such as metal coated with vinyl plastic. The ends 616 of the slats 618 are sized and shaped to snugly fit into the slat-receiving channel 612 of the right-side member 610, and also the opposing left side member, not shown, through a similar channel opening. The end result is that right side member 610 and left side member (not shown) work together to secure a plurality of laterally positioned slats 618, which collectively form an occupant support defining a support surface, either directly for an occupant, or indirectly by supporting a cushion, not shown.

The right-side member 610 further includes a longitudinal screw-access channel 620. A screw hole 622, which can be threaded, is provided between the screw-access channel 620 and the slat-receiving channel 612, and aligns with the respective ends 616 of each slat 618 positioned within the slat-receiving channel 612. A screw 624 is threaded within the screw hole 622 and engages with the end 616 of the slat 618 for the purpose of securing the slat 618 to the right-side member 610. Each slat 618 can be provided with a lower notch 626 that can also receive the screw 624 when threaded through the screw hole 622 with the end 616 of the slat 618 received in the slat-receiving channel 612. At least one screw 224 can be used for each slat 618 inserted within the right-side member 610 (and the left-side member, which is not shown). Using the screws 624 allows the slats 618 to be spaced from each other, preventing the slats 618 from sliding longitudinally within the slat-receiving channels 612. The screws 224, however, are not required in that the slats 618 may include spacers (not shown) which reside only within the slat-receiving channel 612 and function to effectively space each slat 618 a predetermined distance from each other. Also, the slats 618 may be arranged so that each slat abuts against an adjacent slat, thereby keeping each slat properly positioned within the side members. The screws 624 can be selected in accordance with the type of material being used to make the slats 618, and a common type of #8 size pan head Phillips-drive sheet metal screw would likely work for wood, plastic and metal type of slats, as long as the metal slats are made from hollow sheet metal box construction.

As shown in FIG. 18, the screw-access channel 620 includes an opening 628 at a lower end, through which the screws 624 may be inserted to reach their respective screw holes 622, and also the appropriate screw-rotating tool. Two flanges 630 may be included at the opening 628 in the lower end of the screw-access channel 620 for cooperating with the T-bolt 104 (see FIG. 3), for example, for securing side members to the primary frame 12 in a similar manner to that described above with reference to FIGS. 3-6. A chaise lounge having the rigid slats 618 can include a primary frame similar to that shown in FIG. 3 and a secondary frame similar to the secondary frame 34 shown in FIG. 3, the difference being the extrusion profile of the side members and the slats 618 in lieu of the sling 90 shown in FIG. 1.

Figure 19:
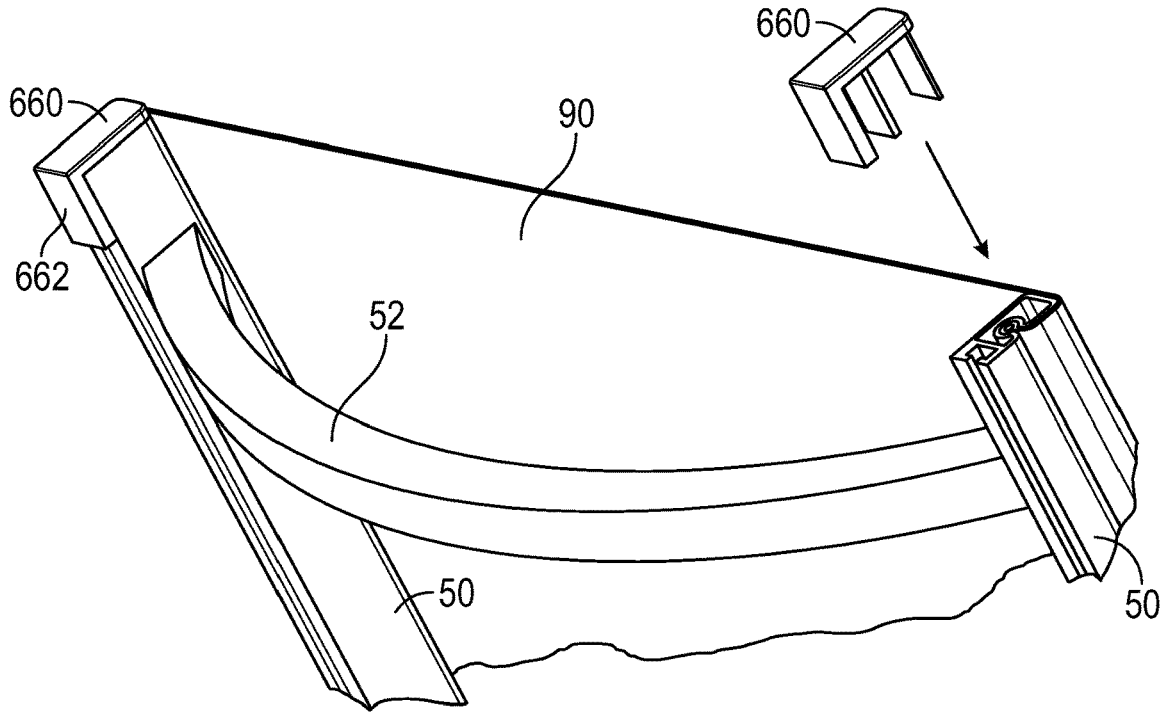
FIG. 19 is a perspective partial view of the secondary frame shown in FIG. 3 showing details of an end cap.

Referring to FIG. 19, an end cap 660 is provided to cover open ends 46 of each seat portion secondary side member 40 (see FIG. 1), and open ends 56 of each backrest portion secondary side member 50. The end cap 660 for each backrest portion secondary side member 50 can include an integrally-formed bottom cushion 662 to protect each backrest portion secondary side member 50 when the backrest portion 38 is lowered against the primary frame 12 as shown in FIG. 1.

Examples of chaise lounges have been described above with particularity. Modifications and alterations will occur to those upon reading the above detailed description. The invention, however, is not limited to only the embodiments described above. It will be appreciated that various of the above-disclosed embodiments and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A chaise lounge comprising:

a frame including at least two side members, at least one cross member connecting the at least two side members and a plurality of legs;

a first sling anchor connected with a first side member of the at least two side members and movable with respect to the frame, wherein the first side member includes a sling anchor-receiving channel and the first sling anchor is received in the sling anchor-receiving channel;

a second sling anchor connected with a second side member of the at least two side members, the second side member being disposed on an opposite side of the frame from the first side member;

a sling secured to the first sling anchor and the second sling anchor and spanning between the first side member and the second side member, the sling defining a support surface on which an associated occupant may selectively reside; and a threaded fastener engaging the first sling anchor and the first side member, wherein rotation of the threaded fastener with respect to at least one of the first sling anchor and the first side member results in movement of the first sling anchor with respect to the first side member, which results in movement of the sling with respect to the first side member, wherein the frame includes:

a primary frame including at least two primary side members connected by at least one primary cross member and the plurality of legs, a secondary frame including at least two secondary side members connected by at least one secondary cross member, the secondary frame being sized and shaped to be supported by the primary frame, wherein the first side member is one of the at least two secondary side members and includes a fastener-receiving channel offset from the sling anchor-receiving channel, and a mechanical fastener at least partially received in the fastener-receiving channel securing the first side member to one of the at least two primary side members.

2. The chaise lounge of claim 1, wherein the second sling anchor is movable with respect to the frame and the threaded fastener is a first threaded fastener, and further comprising a second threaded fastener engaging the second sling anchor and the second side member, wherein rotation of the second threaded fastener with respect to at least one of the second sling anchor and the second side member results in movement of the second sling anchor with respect to the second side member, which results in movement of the sling with respect to the second side member.

3. The chaise lounge of claim 1, wherein the first sling anchor is movable within the sling anchor-receiving channel with respect to the first side member in a direction perpendicular to a longest dimension of the first side member in response to rotation of the threaded fastener.

4. The chaise lounge of claim 1, wherein the primary frame includes a ledge projecting inwardly from at least one primary side member of the at least two primary side members toward another primary side member of the at least two primary side members, the ledge including at least one mounting slot extending therethrough.

5. The chaise lounge of claim 4, further comprising at least one mechanical fastener securing the secondary frame to the ledge, the at least one mechanical fastener including a portion extending through the at least one mounting slot in a direction parallel with a gravitational force being applied on the ledge by the at least one secondary side member when the at least one secondary side member is supported by the ledge.

6. The chaise lounge of claim 5, wherein the at least one mechanical fastener includes a shank and a head, wherein the shank includes the portion of the at least one mechanical fastener extending through the at least one mounting slot to secure the first side member to one of the at least two primary side members.

7. The chaise lounge of claim 6, wherein the fastener-receiving channel is sized and shaped to slidingly receive the head of the at least one mechanical fastener, the fastener receiving section being shaped to allow longitudinal displacement of the at least one mechanical fastener along a longest dimension of the first side member and to inhibit rotation of the shank with respect to the first side member.

8. The chaise lounge of claim 1, wherein the first side member includes a sling-receiving slot leading to the sling anchor-receiving channel, wherein the sling extends through the sling-receiving slot when received in the sling anchor-receiving channel.

9. The chaise lounge of claim 8, wherein the first sling anchor includes a sling-receiving slit leading to a sling-receiving channel, wherein the sling extends through the sling-receiving slit when received in the sling-receiving channel.

10. The chaise lounge of claim 9, wherein the sling includes a hemmed pocket along a first edge and an anchor rod is received in the hemmed pocket to retain the first edge in the sling-receiving channel, wherein a diameter of the anchor rod is greater than a width of the sling-receiving slit.

11. The chaise lounge of claim 1, wherein the first side member includes a thickened section of material, which can be aluminum or steel, disposed beneath the sling anchor-receiving channel, where the thickened section of material is at least one-half the height of the sling anchor-receiving channel.

12. The chaise lounge of claim 1, wherein the second sling anchor includes a plurality of sling edge receiving channels, wherein a first edge of the sling is secured to the first sling anchor and each sling edge receiving channel of the plurality of sling edge receiving channels is configured receive a second edge, which is opposite the first edge, of the sling.

13. The chaise lounge of claim 12, wherein the plurality of sling edge receiving channels an upper sling edge receiving channel, a middle sling edge receiving channel and a lower sling edge receiving channel.

14. A chaise lounge comprising:

a frame including at least two side members, at least one cross member connecting the at least two side members and a plurality of legs;

a first sling anchor connected with a first side member of the at least two side members and movable with respect to the frame;

a second sling anchor connected with a second side member of the at least two side members, the second side member being disposed on an opposite side of the frame from the first side member;

a sling secured to the first sling anchor and the second sling anchor and spanning between the first side member and the second side member, the sling defining a support surface on which an associated occupant may selectively reside; and a threaded fastener engaging the first sling anchor and the first side member, wherein rotation of the threaded fastener with respect to at least one of the first sling anchor and the first side member results in movement of the first sling anchor with respect to the first side member, which results in movement of the sling with respect to the first side member, wherein the first side member includes a sling anchor-receiving channel and the first sling anchor is received in the sling anchor-receiving channel, wherein the first side member includes a sling-receiving slot leading to the sling anchor-receiving channel, wherein the sling extends through the sling-receiving slot when received in the sling anchor-receiving channel, and wherein the first sling anchor includes a sling-receiving slit leading to a sling-receiving channel, wherein the sling extends through the sling-receiving slit when received in the sling-receiving channel.

15. The chaise lounge of claim 14, wherein the sling includes a hemmed pocket along a first edge and an anchor rod is received in the hemmed pocket to retain the first edge in the sling-receiving channel, wherein a diameter of the anchor rod is greater than a width of the sling-receiving slit.

16. A chaise lounge comprising:

a frame including at least two side members, at least one cross member connecting the at least two side members and a plurality of legs;

a first sling anchor connected with a first side member of the at least two side members and movable with respect to the frame, wherein the first side member includes a sling anchor-receiving channel and the first sling anchor is received in the sling anchor-receiving channel;

a second sling anchor connected with a second side member of the at least two side members, the second side member being disposed on an opposite side of the frame from the first side member;

a sling secured to the first sling anchor and the second sling anchor and spanning between the first side member and the second side member, the sling defining a support surface on which an associated occupant may selectively reside; and a threaded fastener engaging the first sling anchor and the first side member, wherein rotation of the threaded fastener with respect to at least one of the first sling anchor and the first side member results in vertical movement of the first sling anchor with respect to the first side member, which results in at least substantially horizontal movement of the sling with respect to the first side member.

17. The chaise lounge of claim 16, wherein the first side member includes a thickened section of material disposed offset from a sling-receiving channel in a direction parallel to a direction in which a threaded fastener moves when rotated with respect to at least one of the first sling anchor and the first side member, where the thickened section of material is at least one-half a dimension of the sling-receiving channel measured parallel to the direction in which a threaded fastener moves when rotated with respect to at least one of the first sling anchor and the first side member.

18. The chaise lounge of claim 17, wherein the thickened section of material is disposed beneath the sling-receiving channel.

19. The chaise lounge of claim 17, wherein the threaded fastener engages the thickened section of material.

20. The chaise lounge of claim 19, wherein the thickened section of material is a steel insert disposed in a lower channel disposed beneath the sling-receiving channel.

* * * * *